US008231321B2

(12) United States Patent
Hasegawa et al.

(10) Patent No.: US 8,231,321 B2
(45) Date of Patent: Jul. 31, 2012

(54) PAPER-PROCESSING AND PUNCHING APPARATUS

(75) Inventors: Takao Hasegawa, Gunma (JP); Naoki Kojima, Gunma (JP); Atsushi Kurabayashi, Gunma (JP)

(73) Assignee: Max Co., Ltd., Tokyo (JP)

( * ) Notice: Subject to any disclaimer, the term of this patent is extended or adjusted under 35 U.S.C. 154(b) by 507 days.

(21) Appl. No.: 11/996,363

(22) PCT Filed: Jul. 25, 2006

(86) PCT No.: PCT/JP2006/315095

§ 371 (c)(1),
(2), (4) Date: Jan. 22, 2008

(87) PCT Pub. No.: WO2007/013650

PCT Pub. Date: Feb. 1, 2007

(65) Prior Publication Data

US 2009/0110516 A1 Apr. 30, 2009

(30) Foreign Application Priority Data

Jul. 26, 2005 (JP) ..... 2005-216562
Jul. 26, 2005 (JP) ..... 2005-216563

(51) Int. Cl.
*B42B 5/08* (2006.01)

(52) U.S. Cl. ..... 412/38; 412/39; 412/40

(58) Field of Classification Search ..... 412/13, 412/33–43

See application file for complete search history.

(56) References Cited

U.S. PATENT DOCUMENTS 6,213,456 B1 * 4/2001 Hirano et al. ..... 270/58.08
6,341,861 B1 1/2002 Sasaki
6,739,818 B2 * 5/2004 Aguirre ..... 412/39

(Continued)

FOREIGN PATENT DOCUMENTS

JP 55044491 3/1980

(Continued)

OTHER PUBLICATIONS

Souki Takashimi, Notification of Rejection Reason(s) for JP 2005-216562, Apr. 22, 2010.

(Continued)

*Primary Examiner* — Edward Tolan
*Assistant Examiner* — Matthew G Katcoff
(74) *Attorney, Agent, or Firm* — Chernoff, Vilhauer, McClung & Stenzel

(57) ABSTRACT

A paper-processing apparatus is provided with a paper-transferring section containing a transfer path for transferring a sheet of paper to a prescribed position and a transfer path to which the transfer route is switchable from the transfer path, a punch-processing section for punching two or more holes for binding in one end of the sheet of paper transferred thereto, and a control section for controlling the paper-transferring section and the punch-processing section wherein the control section controls the paper-transferring section to decelerate and stop the transfer of the sheet of paper at the prescribed position of the transfer path, to switch the transfer route for the sheet of paper from the transfer path to the transfer path, and to deliver the sheet of paper in a reverse direction thereof. The sheet of paper can be transferred to the punch-processing section with the sheet-shaped figure of the sheet of paper kept as it is, and the holes for binding can be punched at one end of the sheet of paper.

32 Claims, 25 Drawing Sheets

U.S. PATENT DOCUMENTS

| | | | |
|---|---|---|---|
| 2003/0102621 | A1 | 6/2003 | Tokutsu |
| 2008/0075560 | A1 | 3/2008 | Kurabayashi et al. |

FOREIGN PATENT DOCUMENTS

| | | | |
|---|---|---|---|
| JP | 55044491 | A | 3/1980 |
| JP | 63204800 | | 8/1988 |
| JP | 525838 | | 6/1993 |
| JP | H05-25838 | | 6/1993 |
| JP | 10291307 | | 11/1998 |
| JP | 10291307 | A | 11/1998 |
| JP | 11035222 | | 2/1999 |
| JP | 11035222 | A | 2/1999 |
| JP | 2003171057 | | 6/2003 |
| JP | 2005138549 | | 6/2005 |
| JP | 2005138549 | A | 6/2005 |
| WO | 2005-044580 | A1 | 5/2005 |

OTHER PUBLICATIONS

Souki Takashimi, Notification of Rejection Reason(s) for JP 2005-216563, Apr. 22, 2010.

Chinese Primary Examination Report for CN 201010547565.3, Nov. 22, 2011 (with English translation).

Adam Piekarski, Extended European Search Report for EP 06768402, Feb. 24, 2012.

* cited by examiner

FIG. 13A HOME
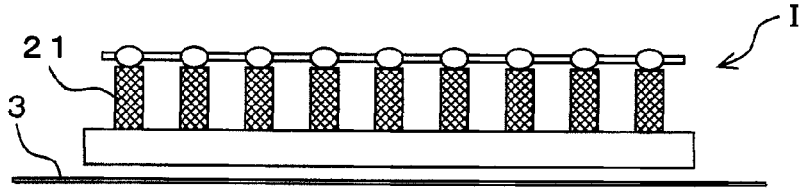
FIG. 13B PASSING-THROUGH STARTED FROM LEFT
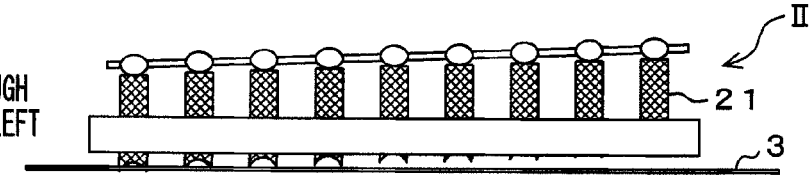
FIG. 13C PASSING-THROUGH COMPLETED
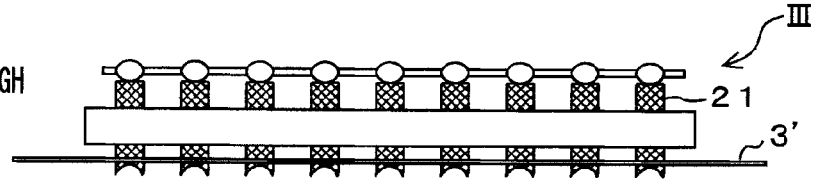
FIG. 13D RETURN FROM LEFT
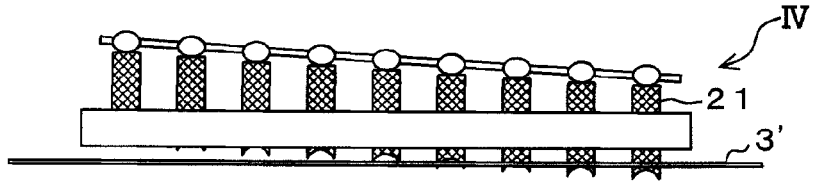
FIG. 13E HOME
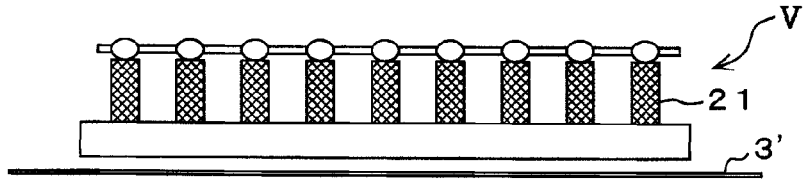

PRIOR ART

PAPER-PROCESSING AND PUNCHING APPARATUS

This is a national stage application filed under 35 USC 371 based on International Application No. PCT/JP2006/315095 filed Jul. 25, 2006, and claims priority under 35 USC 119 of Japanese Patent Application No. 2005-216562 filed Jul. 26, 2005 and Japanese Patent Application No. 2005-216563 filed Jul. 26, 2005.

TECHNICAL FIELD

The present invention relates to a paper-processing apparatus that is preferably applicable to an apparatus for performing punching, binding and the like on a sheet of recorded paper discharged from a monochrome and color copying machine, a printer, and the like. It, specifically, relates to such an apparatus that is provided with controlling means for controlling paper-transferring means to decelerates and stops the transfer of the paper at a predetermined position on a transfer path, to switch a paper transfer route then from this transfer path to the other transfer path, and to perform any switchback control so that the sheet of the corresponding paper can be delivered in a reverse direction, thereby enabling the sheet of the corresponding paper to transfer to punching means with a sheet-shaped figure of the sheet of paper kept as it is, and at the same time, thereby enabling holes for binding to be punched at one end of the sheet of paper with excellent reproducibility.

BACKGROUND ART

In recent years, there have been many cases where a punching device is used in combination with a monochrome and color copying machine, a printer or the like. According to this type of punching device, it receives a sheet of paper recorded with an image, and punches holes at the downstream side of the sheet of paper utilizing its punching function. The sheets of punched paper are re-aligned to one another, and are automatically subject to bounding processing such as ring binding by utilizing the holes. For two-hole file or the like, a method how to file them by hands is also employed.

Further, in a general reciprocal punching device, a sheet of paper temporality stops at a punch-processing section before it is punched. At this time, a method how to detect an end portion of the sheet of paper by a sensor on the transferring way thereof and to correct an amount of its transfer to the punching position is employed. There may be a case where a sheet-reversing function is employed for transferring these sheets of paper.

A configuration of a post-processing apparatus according to a conventional example is shown in FIG. 25. The post-processing apparatus 200 shown in FIG. 25 is configured to contain a paper transfer path 1, a punch-processing section 2, a binder-paper-aligning unit 33, a binding unit 4, a transfer belt 5, a discharge stack 6, and an apparatus main body section 7.

The paper transfer path 1 is located within the apparatus main body section 7, and a switchback roller is provided at one side thereof. The punch-processing section 2 is located below the paper transfer path 1, and a sheet of printed paper 3 fed to the paper transfer path 1 is switched on the traveling direction thereof by the switchback roller. After that, it makes a U-turn and is transferred to the punch-processing section 2.

At the punch-processing section 2, it is configured so that the sheet of paper is punched at the front end thereof in its transfer direction in order to transfer and discharge the sheet of paper under its face-down printing. Below the punch-processing section 2, the binder-paper-aligning unit 33 and the binding unit 4 are located as well as the sheet of punched paper 3 makes a U (an R)-turn and is transferred to the binder-paper-aligning unit 33. In the binder-paper-aligning unit 33, a plurality of sheets of paper 3 are aligned and when a predetermined number of sheets of paper have been aligned, a stack of sheets of paper with the holes punched at the side of binding unit 4 is inclined, and the stack of sheets of paper at this inclined position is bound by a binding member.

A transfer belt 5 and a discharge stack 6 are located at the downstream side of the binder-paper-aligning unit 33 and the stack of sheets of paper (hereinafter, referred to as a booklet 90) bound by a binding member is transferred on the transfer belt 5 and is discharged to the discharge stack 6. In this manner, such a mechanism is employed that the sheet of paper 3 is reversed (from its rear end to its front end), is transferred through the U-turn transfer path to the punch-processing section 2, and is then returned through the U-turn transfer path to the binder-paper-aligning unit 33 (i.e. S-shaped transfer route).

It is to be noted that Japanese Patent Application Publication No. S59-97957 has disclosed a sheet-reverse-dealing apparatus. According to this sheet-reverse-dealing apparatus, it is configured so that when a sheet transferred in a positive direction is reversed and its forwarding direction is switched to be returned to the transfer path, the transfer speed of the sheet after the forwarding direction of the sheet has been switched is set to be faster than the transfer speed of the sheet in the positive direction. According to this configuration of this device, the sheet when being reversed can be transferred at higher speed.

Japanese Utility Model Publication No. H05-25838 has disclosed a punching device. According to this punching device, a flexible plate-like member is provided on a dice on which an item to be punched is placed, and the plate-like member is always pressed onto a side of the dice. It is configured so that when the item to be punched is set during the punching thereof, the flexible plate-like member biases the item to be punched toward the side of the dice. Thus configured apparatus is capable of preventing the item to be punched from isolating from the dice when punched.

Further, Japanese Patent No. H09-2575668 has disclosed a paper-accommodating apparatus. According to this paper-accommodating apparatus, matching means is provided within a tray and in a case of, by a transfer roller, exerting a transfer force to a front corner portion of a sheet of paper to be accommodated in the tray, the paper transfer force exerted by the matching means is set to be smaller than the paper transfer force exerted by the transfer roller. Thus configured apparatus avoids the sheet of paper being made free, and thus, a risk of skew thereof is eliminated.

However, according to a punching device used in combination with a copying machine, a printer, or the like, there are any following problems.

i. The punching device of a conventional scheme shown in Japanese Utility Model Publication No. H05-25838 punches holes in a sheet of paper being transferred at its downstream, in many cases. Contrary to this, in view of the case where holes are punched in a sheet of paper at a side of its upstream utilizing the sheet-reversing function as shown in Japanese Patent Application Publication No. S59-97957 (on page 2) and the punching operation is achieved by having the sheet of paper struck thereagainst utilizing any transferring force, a reference in the sheet of paper and the position to be punched become opposite to each other, so that there is a risk that accuracy of punching position is lowered due to variations in paper sizes and mechanical errors.

ii. Further, in realizing a basic operation of re-aligning sheets of the paper to one another after they have been punched and performing automatic binding on them by utilizing the punched holes, if the punching method of a conventional scheme is employed as it is, there is a risk that accuracy of hole position becomes low and the hole positions of the aligned sheets of paper deviate from one another, and an automatic binding operation is hindered.

iii. In a general type of the reciprocal punching device, it is required to temporally stop a sheet of paper before punching it. At this time, in order to improve accuracy of the hole positions, a method where an end portion of the sheet of paper is detected by a sensor while transferred and an amount of the transfer thereof up to the punching position is corrected is employed. However, in the actual situation, the correction cannot cover the error in the amount of transfer after the detection and the skew in the sheet of paper. Therefore, high accuracy of hole positions is not achieved.

Incidentally, although it is conceivable to employ a method where a fence as a reference is provided in the vicinity of the punching position in order to improve accuracy of the hole positions and to strike a sheet of paper thereagainst, if striking the sheet of paper against the fence at high speed, there is a risk that the paper is flawed.

Further, if a binding apparatus is constituted as one shown in FIG. 25 by combining the sheet reverse function shown in Japanese Patent Application Publication No. S59-97957 with the punching device shown in Japanese Utility Model Publication No. H05-25838, there are following problems.

i. Since a mechanism where a sheet of paper 3 is reversed to be transferred through the U-turn transfer path to the punch-processing section 2 and after that, it is again returned through the U-turn transfer path to the binder-paper-aligning unit 33 is employed, the moving distances of the sheet of paper 3 and the booklet 90 are inevitably set to long.

ii. On the U-turn transfer path and the R-shaped transfer path at low temperature in a dry state, the rigidity of the sheet of paper 3 increases and the sliding resistance thereof increases accordingly so that a rate of occurrence of paper jamming increases (especially, when the paper is thick) or an ability to release paper jamming deteriorates (it is hard to access to the jammed paper by hand). Therefore, there is a risk that high manufacturing cost is required and transferability of the paper folded into the shape of the letter Z deteriorates.

iii. According to the binding apparatus 200 provided with a U-turn transfer path or an R-shaped transfer path, a period of running time of a motor becomes long so that the durability of the motor deteriorates and power consumption by the motor becomes large.

iv. If a paper transfer path accompanying with a U-turn transfer path is installed, a space for the curvature thereof is needed so that a width of the apparatus main body becomes large, thereby resulting in hindrance to make the binding apparatus 200 compact in size.

v. Further, according to the booklet-discharging system shown in FIG. 25, the booklet 90 is horizontally transferred on the transfer belt 5 and is discharged to the discharge stack 6. Since this mechanism is one of the factors of the increased width of the apparatus main body, in view of a mechanism where the booklet 90 is transferred obliquely, for example, when claws are attached to both of two belts and a moving amount of each of the belts is controlled to transfer the booklet while being held by the claws, if the belt claws are hit at high speed against the booklet constituting a large number of sheets of paper and thus heavy in weight, there is a risk that the motor becomes out of order caused by the impact load thereof.

DISCLOSURE OF THE INVENTION

A paper-processing apparatus according to the present invention relates to a paper-processing apparatus for punching holes in a sheet of predetermined paper to discharge the sheet of paper. The paper-processing apparatus is provided with paper-transferring means containing a first transfer path for transferring the sheet of paper toward a predetermined position and a second transfer path to which a transfer route is switchable from the first transfer path, punching means for punching two or more holes for binding at one end of the sheet of paper transferred by the paper-transferring means, and controlling means for controlling the paper-transferring means and the punching means. The controlling means controls the paper-transferring means so as to decelerate and stop the transfer of the sheet of paper at the predetermined position on the first transfer path, to switch the paper transfer route, then, from the first transfer path to the second transfer path, and to deliver the sheet of paper in a reverse direction thereof.

By the first paper-processing apparatus according to the present invention, in a case of punching the holes in the sheet of predetermined paper and discharging the sheet of paper, the paper-transferring means contains a first transfer path for transferring the sheet of paper toward a predetermined position and a second transfer path to which the transfer route is switchable from the first transfer path. On this assumption, the control means controls the paper-transferring means and the punching means. The control means controls the paper-transferring means so as to decelerate and stop the transfer of the sheet of paper at a predetermined position on the first transfer path, to switch the transfer route of the sheet of paper, then, from the first transfer path to the second transfer path, and to deliver the sheet of paper in a reverse direction thereof.

Therefore, it is possible to transfer the sheet of paper from the first transfer path to the punching means with the sheet-shaped figure (flat state) of the sheet of paper kept as it is. This enables the sheet of paper to be prevented from being curled so that holes for binding can be punched at one end of the sheet of paper by the punching means. Therefore, it is possible to provide a paper-processing apparatus having a paper transfer path with the shape of the letter V laid sidelong as opposed to the reverse transfer path in which the sheet of paper is reversed as if it is rolled around the transfer roller.

A paper-processing method according to the present invention is characterized in that the method contains the steps of transferring a sheet of paper toward a predetermined position on a first transfer path, decelerating and stopping the transfer of the sheet of paper at the predetermined position on the first transfer path, switching the transfer route of the sheet of paper from the first transfer path to the second transfer path and delivering the sheet of paper in a reverse direction thereof into a processing system, punching two or more holes for binding at one end of the sheet of paper in the processing system, and discharging the sheet of punched paper.

By the paper-processing method according to the present invention, it is possible to transfer the sheet of predetermined paper from the first transfer path to the processing system with the sheet-shaped figure of the sheet of paper kept as it is when holes are punched in the sheet of paper to be discharged. Thus, this enables the sheet of paper to be prevented from being curled, so that holes for binding can be punched at one end of the sheet of paper by the punching means.

A second paper-processing apparatus according to the present invention is a paper-processing apparatus for binding a plurality of sheets of paper with a binding member to create a booklet. The paper-processing apparatus is provided with paper-transferring means for transferring each sheet of paper to a predetermined position, punching means for punching two or more holes for binding at one end of each sheet of paper transferred by the paper-transferring means, paper-retaining means for aligning the plurality of sheets of paper punched by the punching means and temporality retaining them, and booklet-creating means for binding the plurality of sheets of paper aligned by the paper-retaining means with binding member to create the booklet. The punching means is disposed in such a manner that its paper-punching surface is set at a position having a first depression angle θ1 relative to a transfer surface of the paper-transferring means. The paper-retaining means is disposed in such a manner that its paper-retaining surface is set at a position having a second depression angle θ2 relative to the transfer surface of the paper-transferring means. It is characterized in that the relationship between the first depression angle and the second depression angle is set to θ1<θ2.

By the second paper-processing apparatus according to the present invention, the punching means is not disposed on the transfer route of the paper-transferring means, but is disposed in such a manner that a paper-punching surface is set at a position having the first depression angle θ1 relative to the transfer surface of the paper-transferring means and the paper-retaining means is disposed in such a manner that its paper-retaining surface is set at a position having the second depression angle θ2 relative to the transfer surface of the paper-transferring means so that the relationship between the first depression angle and the second depression angle is set to be θ1<θ2.

Therefore, in transferring the sheet of paper from the punching means to the paper-retaining means, it becomes possible to utilize the own-weight drop of the sheet of paper in the gravity direction thereof. In addition, since the sheet of paper can be moved linearly, the moving distance of the sheet of paper can be set to shorter than that of the paper transfer path accompanying with the U-turn. In this manner, the period of running time of the motor(s) can be shortened, and the durability of the motor(s) can be enhanced and power consumption by the motor(s) can be reduced.

BRIEF DESCRIPTION OF THE DRAWINGS

FIGS. 13A to 13E are conceptual diagrams each for showing an exemplary state of a punching blade 21 as a second embodiment.

BEST MODE FOR CARRYING OUT THE INVENTION

The present invention has been solved the problems described above, and an object thereof is to provide a paper-processing apparatus and a paper-processing method that are capable of transferring a sheet of paper to punching means with the sheet-shaped figure of the sheet of paper kept as it is, and capable of punching holes for binding at one end of the sheet of paper with good reproducibility.

Further, an object thereof is to provide a paper-processing apparatus that, in the case of transferring the sheet of paper from the punch-processing section to the binder-paper-aligning unit and discharging the booklet, is capable of utilizing their own weight in a direction of gravity and capable of setting the moving distances of the sheet of paper and the booklet to be made shorter.

Hereinafter, the following will describe a paper-processing apparatus and a paper-processing method according to embodiments of the present invention with reference to the drawings.

Embodiment 1

Figure 1:
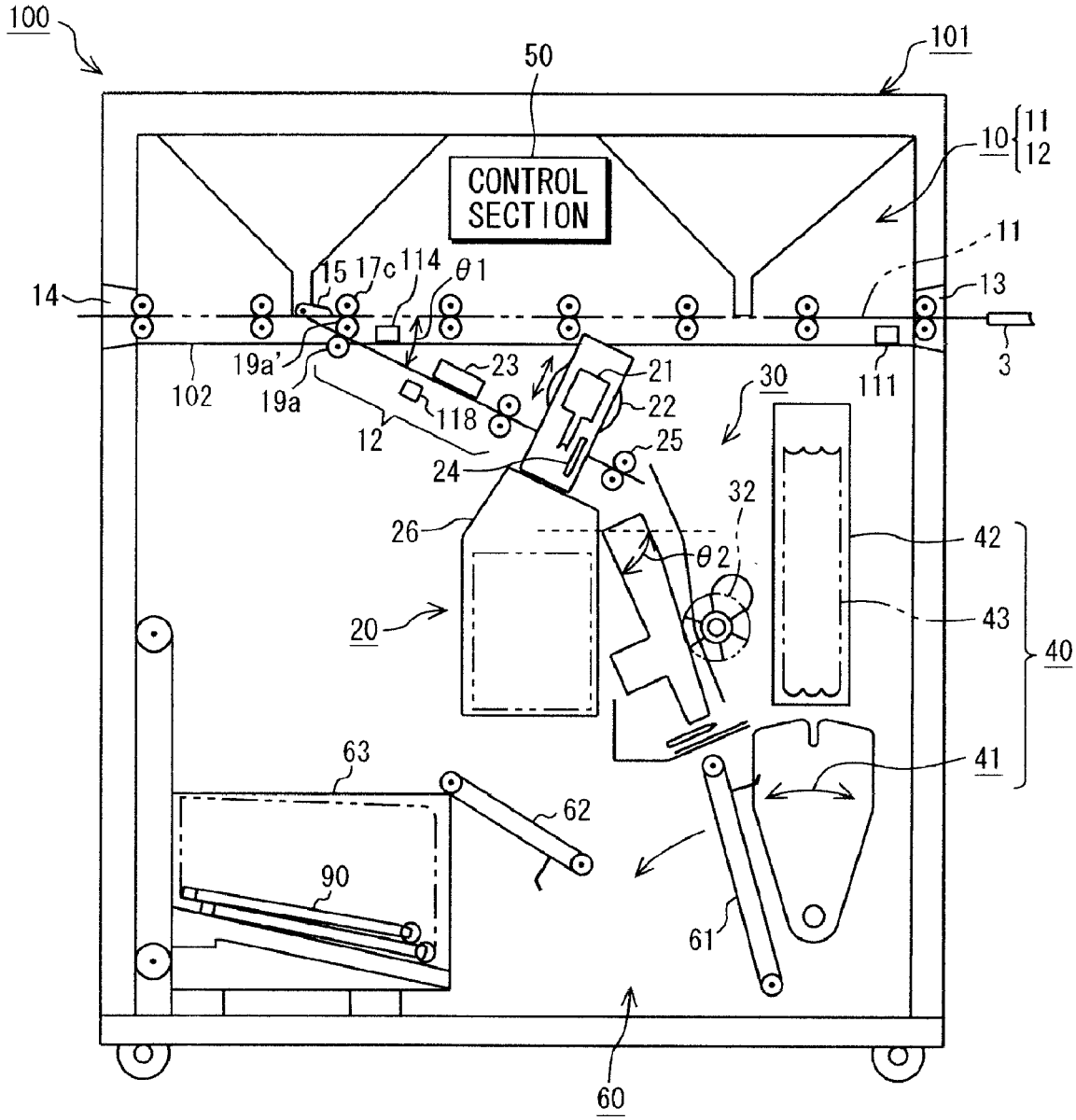
FIG. 1 is a schematic diagram for showing a configuration of a binding apparatus 100 adapting a paper-processing apparatus as each embodiment according to the present invention.

A configuration of a binding apparatus 100 to which a paper-processing apparatus as each embodiment according to the present invention is applied is shown in FIG. 1. The binding apparatus 100 shown in FIG. 1 constitutes an example of the paper-processing apparatus, and is an apparatus which performs punch-processing on each sheet of recorded paper (hereinafter, simply referred to as a sheet of paper 3) coming out of a copying machine or a printer, and then, performs bind-processing thereon by a predetermined binding member (consumable item) 43 to execute discharge. As a matter of course, it can be applied to an apparatus having a function of punching holes in a sheet of predetermined paper 3 and directly discharging it. When a sheet of paper has already been punched, it may be supplied to a binding device (bind-processing section) without being subjected to punching.

The binding apparatus 100 has an apparatus main body section (housing) 101. It is preferable that the binding apparatus 100 is placed adjacent to a copying machine, a printer (image-forming device) or the like when used and the apparatus main body section 101 has a height approximately same as that of the copying machine, printer or the like.

A paper-transferring section 10 that constitutes an example of the paper-transferring means is provided in the apparatus main body section 101. The paper-transferring section 10 contains a first transfer path 11 and a second transfer path 12. The transfer path 11 has a paper feed port 13 and a discharge port 14, and has a through-pass function of transferring the sheet of paper 3 loaded therein through the paper feed port 13 toward the discharge port 14 located at a predetermined position.

The through-pass function herein refers to as a function such that the transfer path 11 positioned between the upstream copying machine, printer, or the like and another downstream paper-processing apparatus directly delivers a sheet of paper 3 from the copying machine, printer, or the like to another paper-processing apparatus. When this through-pass function is selected, acceleration processing of the transfer roller, bind-processing, and the like is eliminated. For making a one-side copy, the sheet of paper 3 is usually transferred under its face-down state. It is configured such that a paper feed sensor 111 is mounted to the paper feed portion 13, for sensing a top end of the sheet of paper 3 and outputting a fed-paper-sensing signal S11 to a control section 50.

The transfer path 12 has a switchback function capable of switching the transfer route from the transfer path 11 thereto. The switchback function herein refers to as a function such that the transfer of the sheet of paper 3 decelerates and stop at a predetermined position on the transfer path 11, and then, the transfer route of the sheet of paper 3 is switched from the transfer path 11 to the transfer path 12, as well as the sheet of paper 3 delivers in a reverse direction thereof. It is configured so that a flap 15 is provided on the transfer path 11, which is used for switching the transfer route from the transfer path 11 to the transfer path 12.

At the switching point between the transfer path 11 and the transfer path 12, a set of three transfer rollers 17*c*, 19*a*', 19*a* is provided. The transfer rollers 17*c* and 19*a* rotate clockwise whereas the transfer roller 19*a*' rotates counter-clockwise. For example, the transfer roller 19*a*' is a drive roller whereas the transfer rollers 17*c* and 19*a* are driven rollers. The sheet of paper 3 taken by the transfer rollers 17*c* and 19*a*' decelerates and stops but when the flap 15 is switched from the upward direction to the downward direction, it is then fed by the transfer rollers 19*a*' and 19*a* and is transferred to the transfer path 12. At the upstream of the set of three transfer rollers 17*c*, 19*a*', 19*a*, a paper-sensing sensor 114 is disposed, for sensing a top end and a rear end of the sheet of paper and outputting a paper-sensing signal S14 to the control section 50.

At the downstream of the transfer path 12, a punch-processing section 20 as an example of punching means is located. It is designed in this embodiment so that a predetermined angle is determined between the transfer path 11 and the transfer path 12 described above. For example, a first depression angle θ1 is determined between the transfer surface of the transfer path 11 and the paper-punching surface of the punch-processing section 20. The paper-punching surface herein refers to as a surface on which the sheet of paper 3 is punched. The punch-processing section 20 is provided in such a manner that its paper-punching surface is set on a location that has the depression angle θ1 relative to the transfer surface of the transfer path 11.

In the punch-processing section 20, it is configured so that two or more holes for binding are punched on one end of the sheet of paper 3 which has been switched back from the transfer path 11 and transferred to the transfer path 12. The punch-processing section 20 contains, for example, a motor 22 for driving punching blades 21 that are capable of being reciprocated. The sheets of paper 3 are punched one by one by the punching blades 21 driven by the motor 22.

A retractable fence 24 as a reference of punching position is provided within the punch-processing section 20, and is used to bring the sheet of paper 3 to hit thereagainst. Further, it is configured so that a side jogger 23 as an example of paper-position-correcting means is provided in the punch-processing section 20, for correcting a position of the sheet of paper 3. For example, it is configured so that the top end of the sheet of paper 3 is equally brought into contact with the retractable fence 24 as an example of positional reference means. The fence 24 constitutes a positional reference for lining up an edge portion of the sheet of paper. It is configured so that at the upstream side of the side jogger 23, a paper-sensing sensor 118 is provided, for sensing a top end and a rear end of the sheet of paper and outputting a paper-sensing signal S18 to the control section 50.

The punch-processing section 20 stops the sheet of paper 3 by bringing it into contact with the fence 24, and then, punches the top end of the sheet of paper 3. It is configured so that below the punching main body, a punched scrap storage section 26 is provided for storing the scraps punched by the punching blade 21. It is configured so that at the downstream of the punch-processing section 20, a paper discharge roller 25 as an example of paper-discharging means is provided, for transferring the sheet of punched paper 3 to the posterior unit.

It is configured so that at the downstream of the punch-processing section 20, a binder-paper-aligning unit 30 as an example of paper-retaining means is disposed, for temporarily retaining (storing) a plurality of sheets of paper 3 discharged from the punch-processing section 20 with the positions of their holes being aligned to one another. The binder-paper-aligning unit 30 is disposed in such a manner that its paper-retaining surface is situated at a position having a second depression angle θ2 relative to the transfer surface of the transfer section 11. The paper-retaining surface herein refers to as a surface for retaining (stacking in layers) the sheets of punched paper. In this embodiment, the relationship between the depression angles θ1 and θ2 is set to θ1<θ2. For example, the depression angle θ1 is set to 0°<θ1<45°, and the depression angle θ2 is set to 0°<θ2<90°, respectively. This setting is to reduce the width of the apparatus main body section 101 and to enable the sheet of paper 3 to be transferred linearly under this condition.

It is configured so that the binder-paper-aligning unit 30 has a paper-guiding-and-pressing function, for guiding the sheet of paper 3 to a predetermined position as the sheet of paper 3 enters thereinto, and for pressing the rear end of the sheet of paper 3 after the sheet of paper 3 has been completely entered thereinto. Further, the binder-paper-aligning unit 30 has a function for aligning corner portion and top end of each of the sheets of paper, for guiding the top end of each of the sheets of paper 3 to a proper position of a rotary member in the shape of a plurality of flaps (hereinafter, referred to as a puddle roller 32) that aligns the top end and the lateral end of each of the sheets of paper 3 to the reference positions when the sheet of paper enters thereinto.

It is configured so that at the downstream of the binder-paper-aligning unit 30, a bind-processing section 40 is disposed, for binding a bundle of the plurality of sheets of paper aligned to one another by the unit 30 with a binding member 43 so as to create a booklet 90. The booklet 90 refers to as a bundle of the sheets of paper fixed and bound to one another by the binding member 43.

In this embodiment, the bind-processing section 40 has a moving mechanism 41. The moving mechanism 41 moves as if it rotates back and forth between a position along the paper transfer direction of the binder-paper-aligning unit 30 and a position orthogonal to the transfer direction of the paper-transferring section 10 described above. The bind-processing section 40 has a binder (binding member) cassette 42. In the binder cassette 42, a plurality of binding members is set. The binding members are manufactured by, for example, injection molding, and plural kinds thereof are prepared to address any thicknesses of the bundles of sheets of paper.

The moving mechanism 41, for example, draws and holds one piece of binding member 43 from the binder cassette 42 at the position orthogonal to the transfer direction of the paper-transferring section 10, and in this state, rotates to a position that provides a good view towards the paper transfer direction of the binder-paper-aligning unit 30. At this position, the bind-processing section 40 receives from the binder-paper-aligning unit 30 a bundle of the sheets of paper whose punched holes are positioned relative to one another, and fits the binding member 43 through the punched holes to perform bind-processing thereon (automatic binding function).

It is configured so that at the downstream of the bind-processing section 40, a discharge unit 60 that constitutes an example of discharging means is disposed, for performing discharge-processing on the booklet 90 created by the bind-processing section 40. The discharging unit 60 is constituted to contain, for example, a first belt unit 61, a second belt unit 62, and a stacker 63.

It is configured so that the belt unit 61 constitutes an example of booklet-receiving-and-switching section, for receiving the booklet 90 fallen from the binder-paper-aligning unit 30 and switching its delivery direction. For example, it is configured so that a main body of the belt unit takes a turn from the position that provides a good view towards the paper transfer direction of the binder-paper-aligning unit 30 to a predetermined discharging direction.

It is configured so that the belt unit 62 constitutes an example of booklet-transferring section, for receiving and relaying the booklet 90 whose delivery direction has been switched by the belt unit 61. It is configured so that the stacker 63 constitutes an example of booklet-reserving section, for accumulating the booklets 90 transferred by the belt units 61 and 62.

Figure 2:
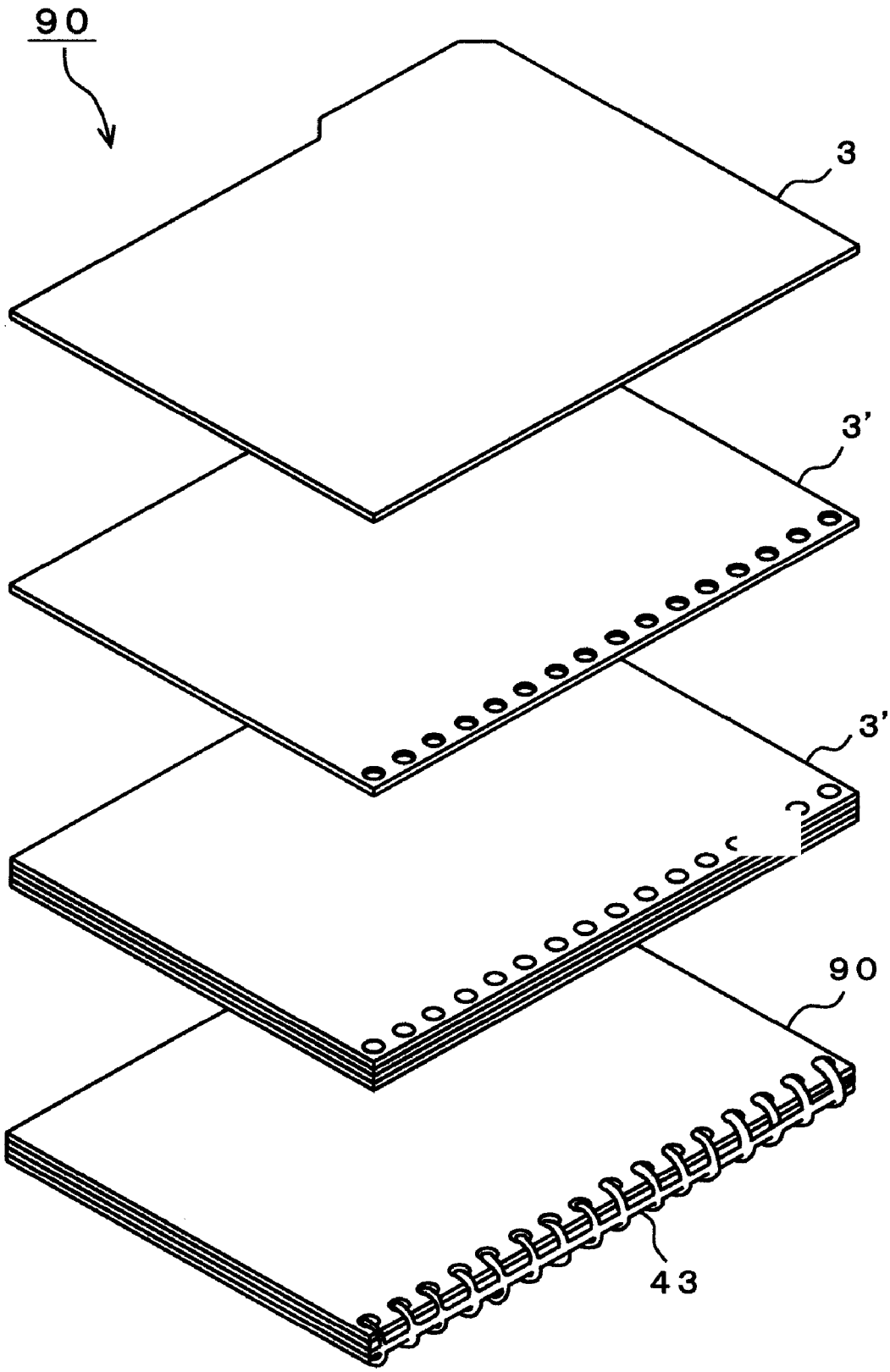
FIG. 2 is a process diagram for showing an exemplary function of the binding apparatus 100.

The following will describe an example of function of the binding apparatus 100 according to the present invention and the paper-processing method with reference to FIG. 2. The sheet of paper 3 has been fed from the upstream side of the binding apparatus 100. This has no punched hole. The sheet of paper 3 is transferred to the predetermined position on the transfer path 11 shown in FIG. 1, and is decelerated to stop at the predetermined position on the transfer path 11. After that, the transfer route of the sheet of paper 3 is switched from the transfer path 11 to the transfer path 12, and the sheet of paper 3 is delivered in the reverse direction thereof to be transferred to the punch-processing section 20.

In the punch-processing section 20, a predetermined number of holes for binding are punched at one end of the sheet of paper 3. The sheet of paper 3' on which the holes for binding are punched is transferred to the binder-paper-aligning unit 30. At the point of time when a predetermined number of the sheets of paper have been reached, the binder-paper-aligning unit 30 aligns the positions of the holes for binding to one another, and fits a binding member 43 through the holes for binding in cooperation with the bind-processing section 40. In this manner, a booklet 90 bound by the binding member 43 can be obtained.

Figure 3:
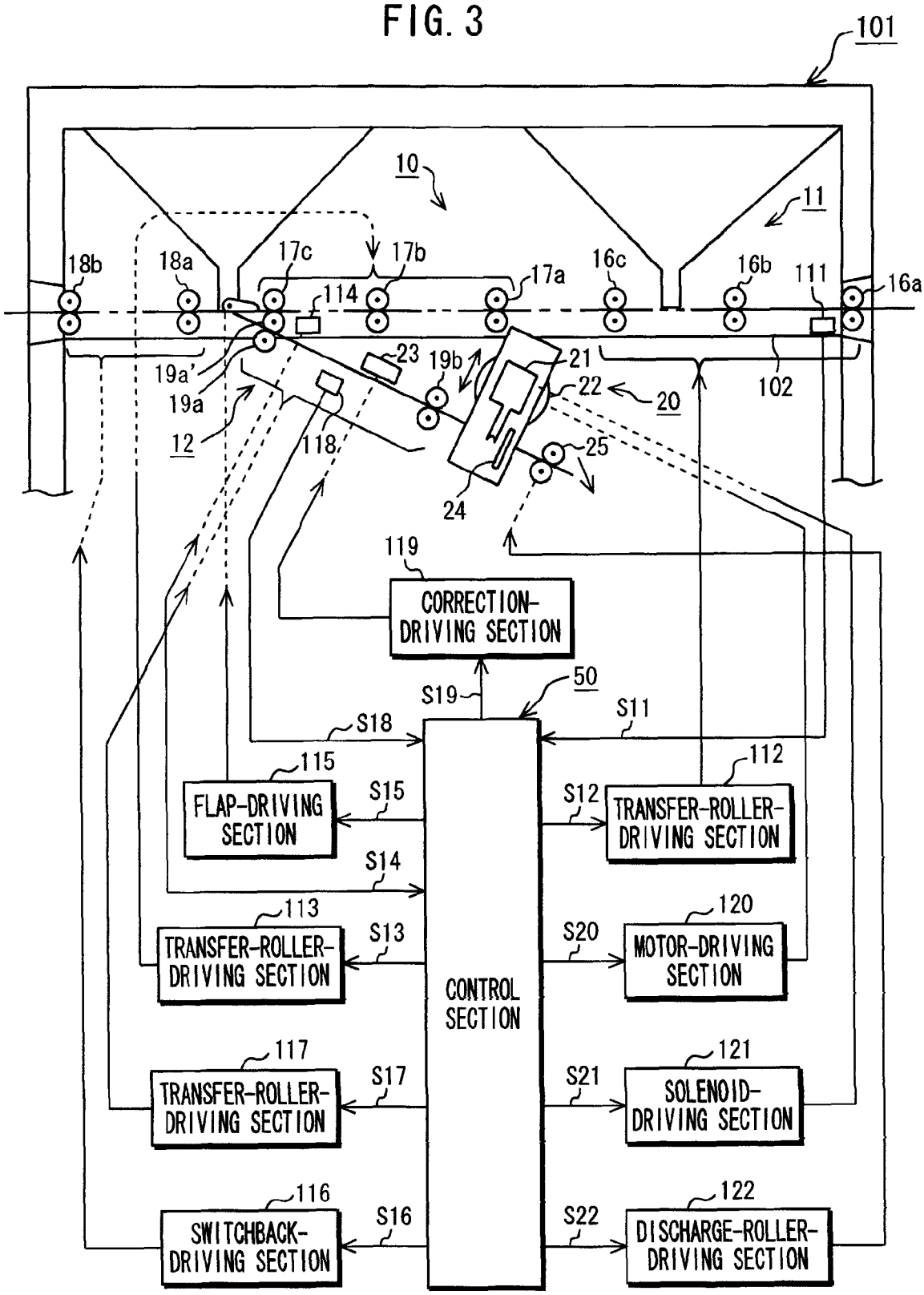
FIG. 3 is a block diagram for showing a configuration of a paper-transferring section 10 and a control system for a punch-processing section 20 in the binding apparatus as a first embodiment.

A configuration of a control system of each of the paper-transferring section 10 and the punch-processing section 20 in the binding apparatus 100 according to the first embodiment is shown in FIG. 3. It is configured so that the binding apparatus 100 shown in FIG. 3 is provided with the control section 50 as an example of control means, for controlling the paper-transferring section 10 and the punch-processing section 20. The control section 50 is provided within the apparatus main body section 101.

The paper-transferring section 10 contains transfer rollers (pairs) 16*a* to 16*c*, 17*a* to 17*c*, 18*a* and 18*b* on the transfer path 11. It also contains transfer rollers 19*a* and 19*b* on the transfer path 12, respectively. The transfer rollers 16*a* to 16*c*, 17*a* to 17*c*, 18*a* and 18*b* are movably attached to an upper partitioning plate 102 provided within the apparatus main body 101. The flap 15 is provided between the transfer roller 17*c* and the transfer roller 18*a*, and operates to depress the rear end of the sheet of paper 3 downward at the time of its switchback operation. The transfer rollers 19*a* and 19*b* are movably attached to an inclined plate, not shown, provided below the upper partitioning plate 102.

Further, the paper-transferring section 10 contains the paper feed sensor 111, a first transfer-roller-driving section 112, a second transfer-roller-driving section 113, the paper-sensing sensor 114, a flap-driving section 115, a switchback-driving section 116, and a third transfer-roller-driving section 117. The paper feed sensor 111 is connected to the control section 50, for sensing the sheet of paper 3 taken into the apparatus 100. The paper feed sensor 11 senses, for example, the top end of the sheet of paper 3 and outputs a fed-paper-sensing signal S11 to the control section 50.

It is configured so that the transfer-roller-driving section 112 is connected to the control section 50, for transferring the sheet of paper 3 taken into the apparatus 100 toward a predetermined direction. The transfer-roller-driving section 112 drives, for example, the transfer rollers 16*a* to 16*c*, to feed the sheet of paper 3 at a speed same as that of any upstream outputting equipment. The control section 50 outputs a first transfer-driving signal S12 to the transfer-roller-driving section 112.

It is configured so that on top of the transfer-roller-driving section 112, the transfer-roller-driving section 113 is also connected to the control section 50, for transferring the sheet of paper 3 taken into the apparatus 100 toward a predetermined direction at high speed. The control section 50 controls the transfer-roller-driving section 113 so as to elongate an interval between the sheets of paper by setting the transfer speed of the sheet of paper 3 to a speed higher than the transfer speed at a point of time when the sheet of paper 3 is fed. Such this control enables a period of processing time required for switchback operation and the like to be ensured. It is configured so that the transfer-roller-driving section 113 drives the transfer rollers 17*a* to 17*c* to transfer the sheet of paper 3 at a speed, for example, twice as fast as the speed achieved by the above-mentioned transfer-roller-driving section 112. The control section 50 outputs a second transfer-driving signal S13 for instructing the transfer-roller-driving section 113 to perform high speed control thereon.

Further, it is configured so that on top of the paper feed sensor 111, a paper-sensing sensor 114 is connected to the control section 50, for sensing the reach of the sheet of paper 3 at the switchback point. It is configured so that the paper-sensing sensor 114 senses, for example, the top end and the rear end of the sheet of paper 3 and outputs the paper-sensing signal S14 to the control section 50.

Further, it is configured so that a flap-driving section 115 is connected to the control section 50 to drive the flap 15 shown in FIG. 1 based on the paper-sensing signal S14. It is configured so that the control section 50 outputs a flap-driving signal S15 to the flap-driving section 115 which drives the flap 15 based on this flap-driving signal S15.

It is configured so that the switchback-driving section 116 is connected to the control section 50 to decelerate and stop the sheet of paper 3 based on a switchback-driving signal S16. It is configured so that the control section 50 outputs the switchback-driving signal S16 to the switchback-driving section 116 which drives the transfer rollers 18*a* and 18*b* based on the switchback-driving signal S16.

For example, upon receiving the paper-sensing signal S14 from the paper-sensing sensor 114, the control section 50 controls the switchback-driving section 116 to decelerate and stop the transfer of the sheet of paper 3 at the switchback position on the transfer path 11. It is configured so that the control section 50 then outputs the flap-driving signal S15 to the flap-driving section 115 which drives the flap 15 based on the flap-driving signal S15. Thus, the transfer route of the sheet of paper 3 is switched from the transfer path 11 to the transfer path 12. The control section 50 controls the switchback-driving section 116 so as to deliver the sheet of paper 3 in a reverse direction thereof.

It is configured so that on top of the transfer-roller-driving sections 112, 113, the transfer-roller-driving section 117 is connected to the control section 50, for driving the transfer rollers 19*a* and 19*b* to transfer the sheet of switched-back paper 3 toward the punch-processing section 20. The control section 50 outputs a third transfer-driving signal S17 to the transfer-roller-driving section 117.

Further, the punch-processing section 20 contains the paper-sensing sensor 118, a correction-driving section 119, a motor-driving section 120, a solenoid-driving section 121, and a discharge-roller-driving section 122. It is configured so that the paper-sensing sensor 118 is connected to the control section 50, for sensing the reach of the sheet of paper 3 to the punch-processing system. The paper-sensing sensor 118 senses, for example, the front end and the rear end of the sheet of paper 3, and outputs the paper-sensing signal S18 to the control section 50.

It is configured so that the correction-driving section 119 is connected to the control section 50, for correcting a position of the sheet of paper 3 in the punch-processing section 20. For example, the correction-driving section 119 controls and drives the side jogger 23 based on a paper-position-correcting signal S19 to give any vibrations to the sheet of paper 3 from the side(s) thereof. The control section 50 outputs the paper-position-correcting signal S19 to the correction-driving section 119.

It is configured so that the motor-driving section 120 is connected to the control section 50, for driving punching blades. The control section 50 outputs a motor-driving signal S20 to the motor-driving section 120. It is configured so that the solenoid-driving section 121 is connected to the control section 50, for driving the fence 24 to move upward and downward. The control section 50 outputs a solenoid-driving signal S21 to the solenoid-driving section 121. It is configured so that the discharge-roller-driving section 122 is connected to the control section 50, for driving the discharge roller 25. The discharge roller 25 discharges a sheet of punched paper 3' to the binder-paper-aligning unit 30. The control section 50 outputs a discharge-driving signal S22 to the discharge-roller-driving section 122.

The following describe an example of operation of the binding apparatus 100 upon transferring and punching a sheet of paper. In this embodiment, description will be made independently as to an example of switchback operation in the binding apparatus 100 and an example of paper transfer and punch-processing operations after the switchback in the binding apparatus 100.

[Example of the Switchback Operation]

Figures 4A, 4B, 4C:
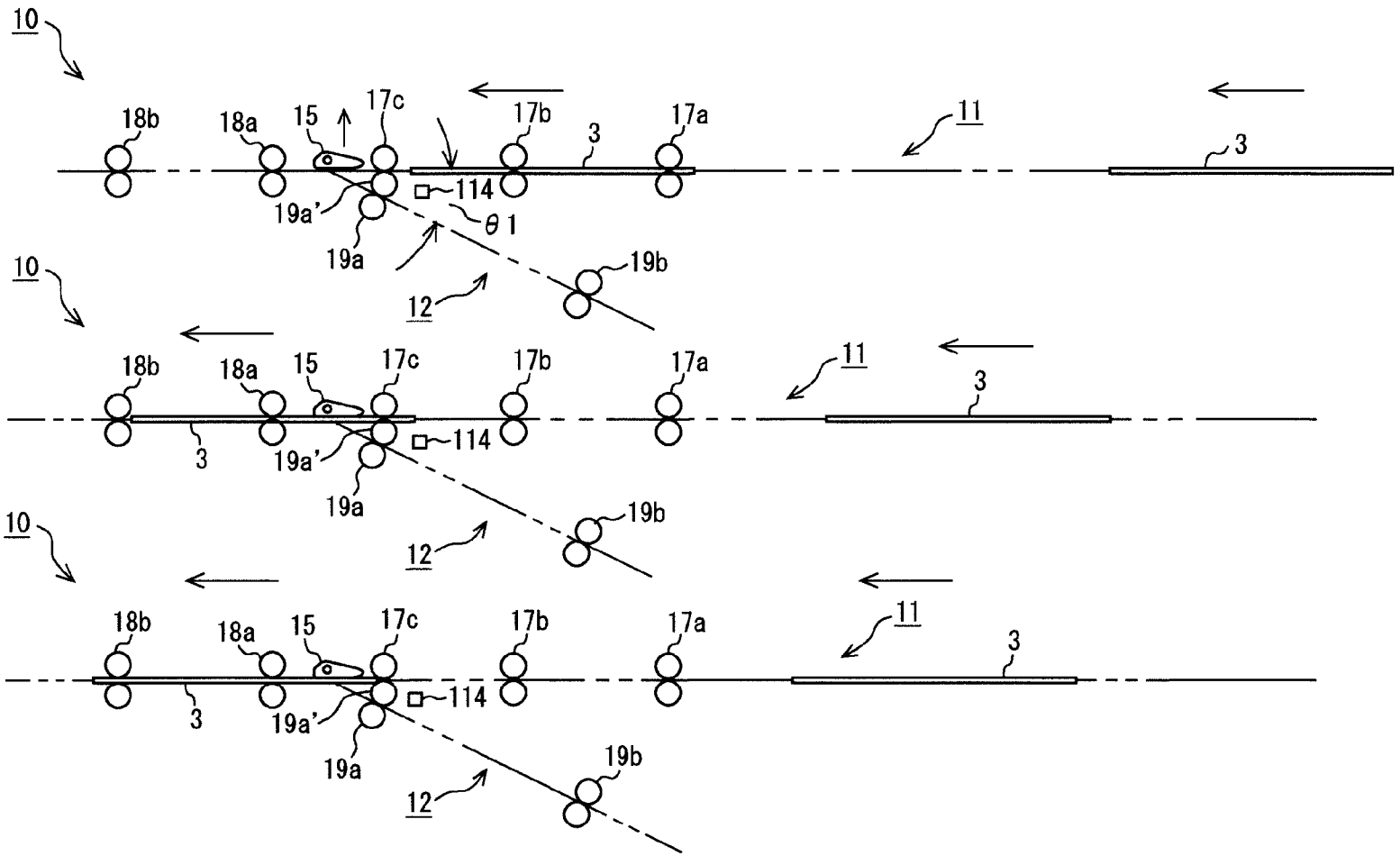
FIGS. 4A to 4C are transition diagrams of a sheet of paper 3 for showing an exemplary switchback operation (Part. 1).

An example of the switchback operation as a first embodiment (Parts. 1 to 3) is shown in FIGS. 4 to 6. A first sheet of paper 3 shown in FIG. 4A is fed from the upstream of the binding apparatus 100. At this time, the paper feed sensor 111 senses the top end of the sheet of paper 3 taken into the apparatus 100 and outputs the fed-paper-sensing signal S11 to the control section 50. It is to be noted that a second sheet of paper 3 is subsequently fed from the upstream.

The sheet of paper 3 is transferred to the switchback position on the transfer path 11 shown in FIG. 3. It is configured so that at this time, the transfer-roller-driving section 112 receives the transfer-driving signal S12 from the control section 50 and transfers the sheet of paper 3 taken into the apparatus 100 toward the switchback position based on the transfer-driving signal S12. The transfer-roller-driving section 112 drives the transfer rollers 16*a* to 16*c* shown in FIG. 3 to feed the sheet of paper 3 at a speed same as that of the upstream outputting equipment.

Further, it is configured so that the transfer-roller-driving section 113 shown in FIG. 3 receives the transfer-driving signal S13 from the control section 50 and transfers the sheet of paper 3 taken into the apparatus 100 to the switchback position at high speed. It is configured so that the transfer-roller-driving section 113 drives the transfer rollers 17*a* and 17*b* to transfer the sheet of paper 3 at a speed, for example, twice as fast as the speed achieved by the transfer-roller-driving section 112 described above. The control section 50 controls the paper-transferring section so as to elongate the interval between the sheets of paper by setting the transfer speed of the sheets of paper 3 on the transfer path 11 to a speed higher than the transfer speed at a point of time when the sheet of paper 3 is fed. Such this control enables a period of processing time required for the switchback operation and the like to be ensured.

After that, when the rear end of the first sheet of paper 3 shown in FIG. 4B is sensed, the sheet of paper 3 is decelerated before the switchback position. At this time, the paper-sensing sensor 114 senses the reach of the sheet of paper 3 which is entering into the switchback point. The paper-sensing sensor 114 detects the top end of the sheet of paper 3 and outputs the paper-sensing signal S14 to the control section 50.

The first sheet of paper 3 stops at the position shown in FIG. 4C. At this time, after sensing the rear end of the first sheet of paper 3, the switchback-driving section 116 receives the switchback-driving signal S16 from the control section 50 and controls the deceleration and stop of the sheet of paper 3 based on this switchback-driving signal S16. For example, it is configured so that after the rear end of the sheet of paper 3 has been sensed, the switchback-driving section 116 starts to decelerate the transfer rollers 18*a* and 18*b* based on the switchback-driving signal S16, and then, stops the transfer rollers 18*a* and 18*b*. As a result, the first sheet of paper 3 stops.

Figures 5A, 5B, 5C:
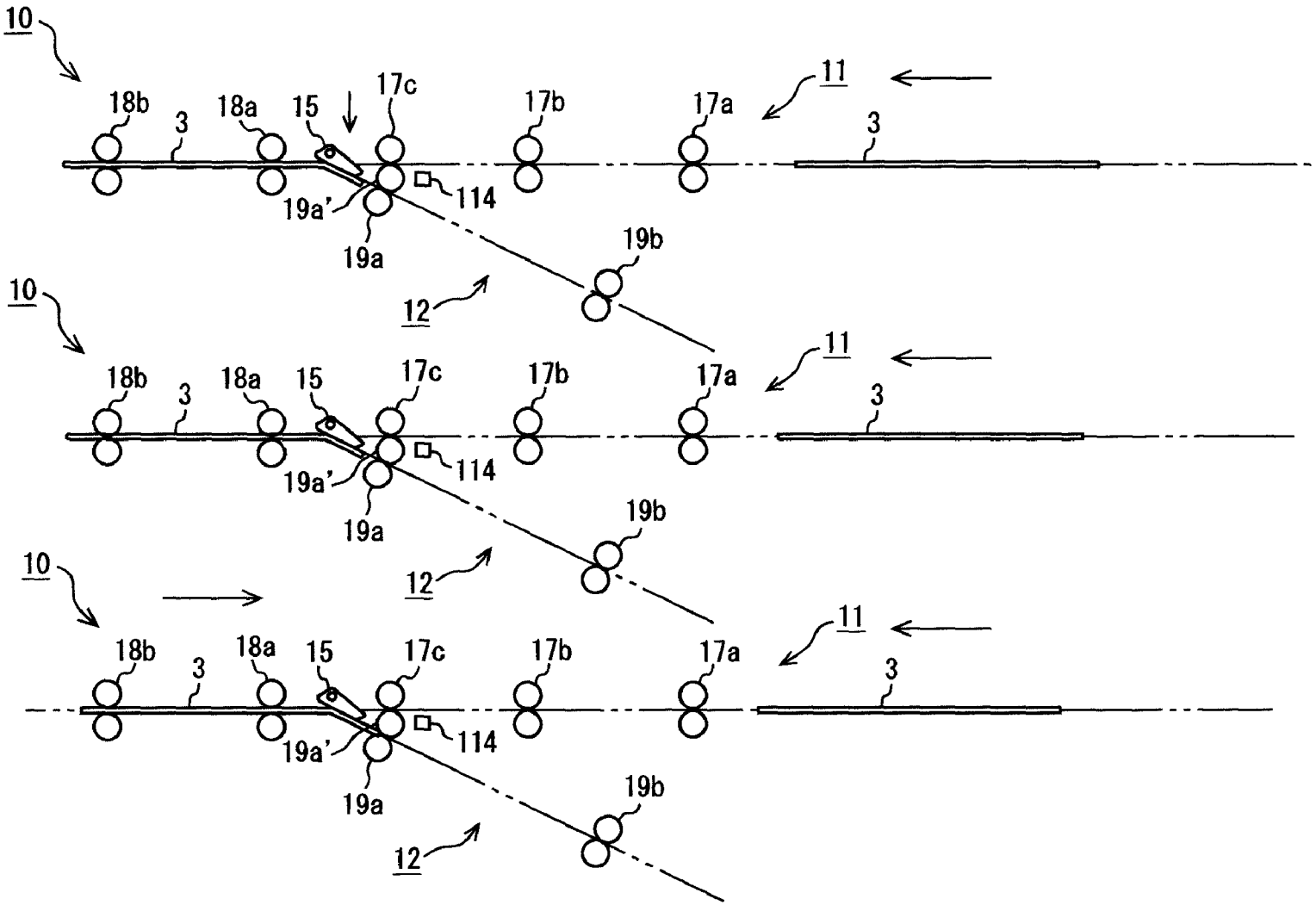
FIGS. 5A to 5C are transition diagrams of the sheet of paper 3 for showing an exemplary switchback operation (Part. 2).

Further, the flap-driving section 115 receives the flap-driving signal S15 from the control section 50 and drives the flap 15 shown in FIG. 5A based on this flap-driving signal S15. After the rear end of the sheet of paper 3 has been sensed, the flap-driving section 115 starts to move the flap 15 downward based on the flap-driving signal S15. Upon completion of this operation, the transfer route of the sheet of paper 3 is switched from the transfer path 11 to the transfer path 12 as shown in FIG. 5B.

Next, the first sheet of paper 3 shown in FIG. 5C is reversed and its acceleration is started. At this time, it is configured so that the switchback-driving section 116 receives the switchback-driving signal S16 from the control section 50 and drives the transfer roller (reversing roller) 18*a* to reverse and accelerate based on this switchback-driving signal S16. The first sheet of paper 3 delivers into a reverse direction thereof by this transfer roller 18*a*.

Figures 6A, 6B, 6C:
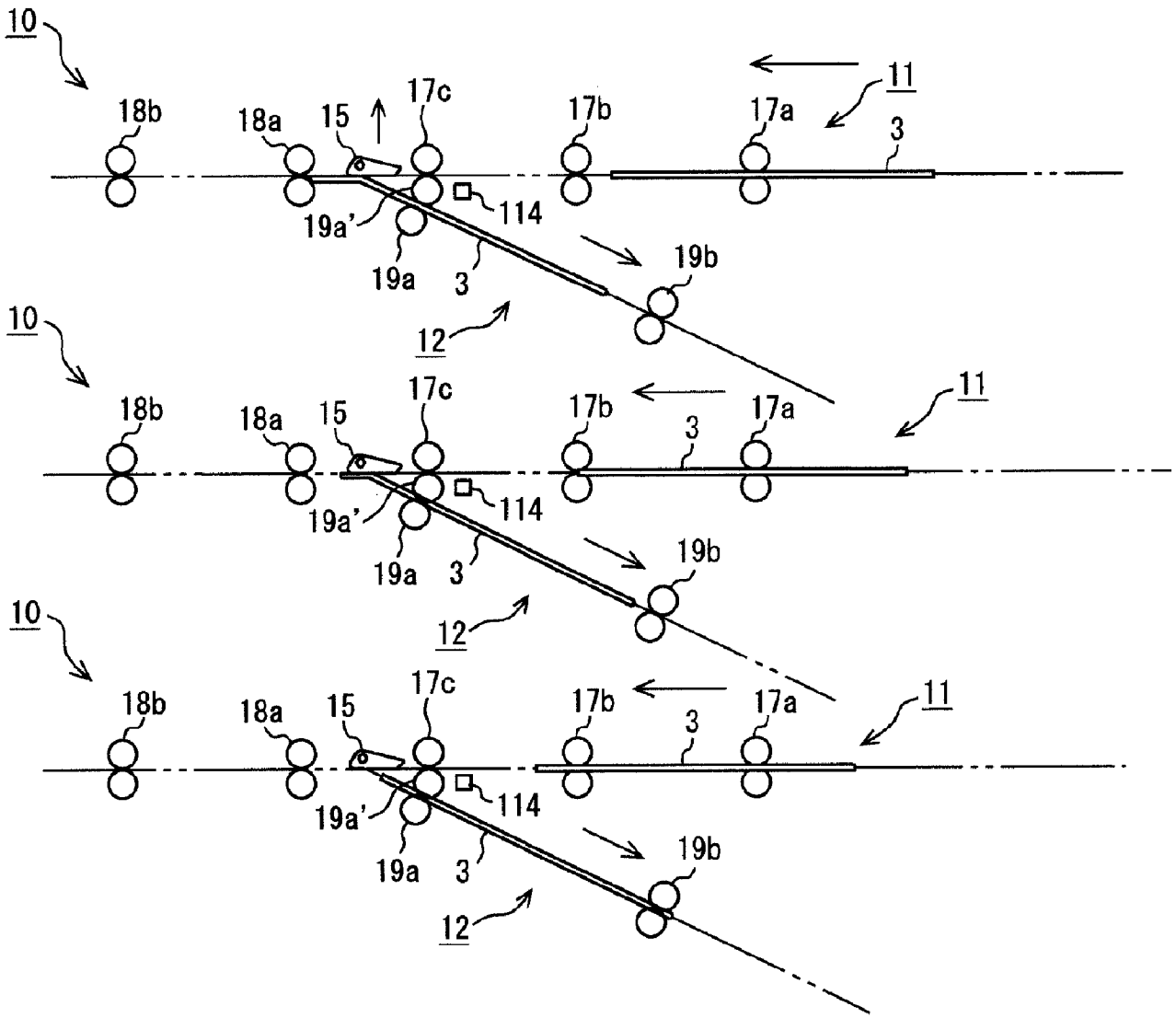
FIGS. 6A to 6C are transition diagrams of the sheet of paper 3 for showing an exemplary switchback operation (Part. 3).

It is to be noted that when the first sheet of the paper 3 has come out of the transfer roller 18*a* as in FIG. 6A, the flap 15 starts to move upward. In this moment, the deceleration of the transfer roller 18*a* starts. At this time, the flap-driving section 115 receives the flap-driving signal S15 from the control section 50 and drives the flap 15 shown in FIG. 6A based on this flap-driving signal S15. After the sheet of paper 3 has come out of the transfer roller, the flap-driving section 115 starts to move the flap 15 upward based on the flap-driving signal S15.

Further, the switchback-driving section 116 receives the switchback-driving signal S16 from the control section 50 and controls the transfer roller 18*a* to decelerate and stop based on this switchback-driving signal S16. It is configured so that, for example, after the sheet of paper 3 has come out of the transfer roller, the switchback-driving section 116 starts to decelerate the transfer roller 18*a* based on the switchback-driving signal S16, and then, stops the transfer roller 18*a*. As a result, the transfer roller 18*a* stops as in FIG. 6B (deceleration completed).

The transfer-roller-driving section 117 then receives the transfer-driving signal S17 from the control section 50 and drives the transfer rollers 19*a*, 19*b* based on the transfer-driving signal S17. As a result, the first sheet of switched-back paper 3 shown in FIG. 5C can be transferred by the transfer rollers 19*a*, 19*b* toward the punch-processing section 20. The switchback operation for the first sheet of paper 3 shown in FIG. 6C is completed. The operation is shifted to a switchback-receiving operation for a second sheet of paper 3.

[Example of Paper Transfer and Punch-Processing Operations after the Switchback]

An example of paper transfer and punch-processing operations after the switchback is shown in FIGS. 7 to 9. It is configured so that in this embodiment, before performing the punch-processing on the sheet of paper 3, the position of the sheet of paper 3 is corrected. The operation of correcting the position thereof is performed in a decelerated state.

Figures 7A, 7B, 7C, 7D:
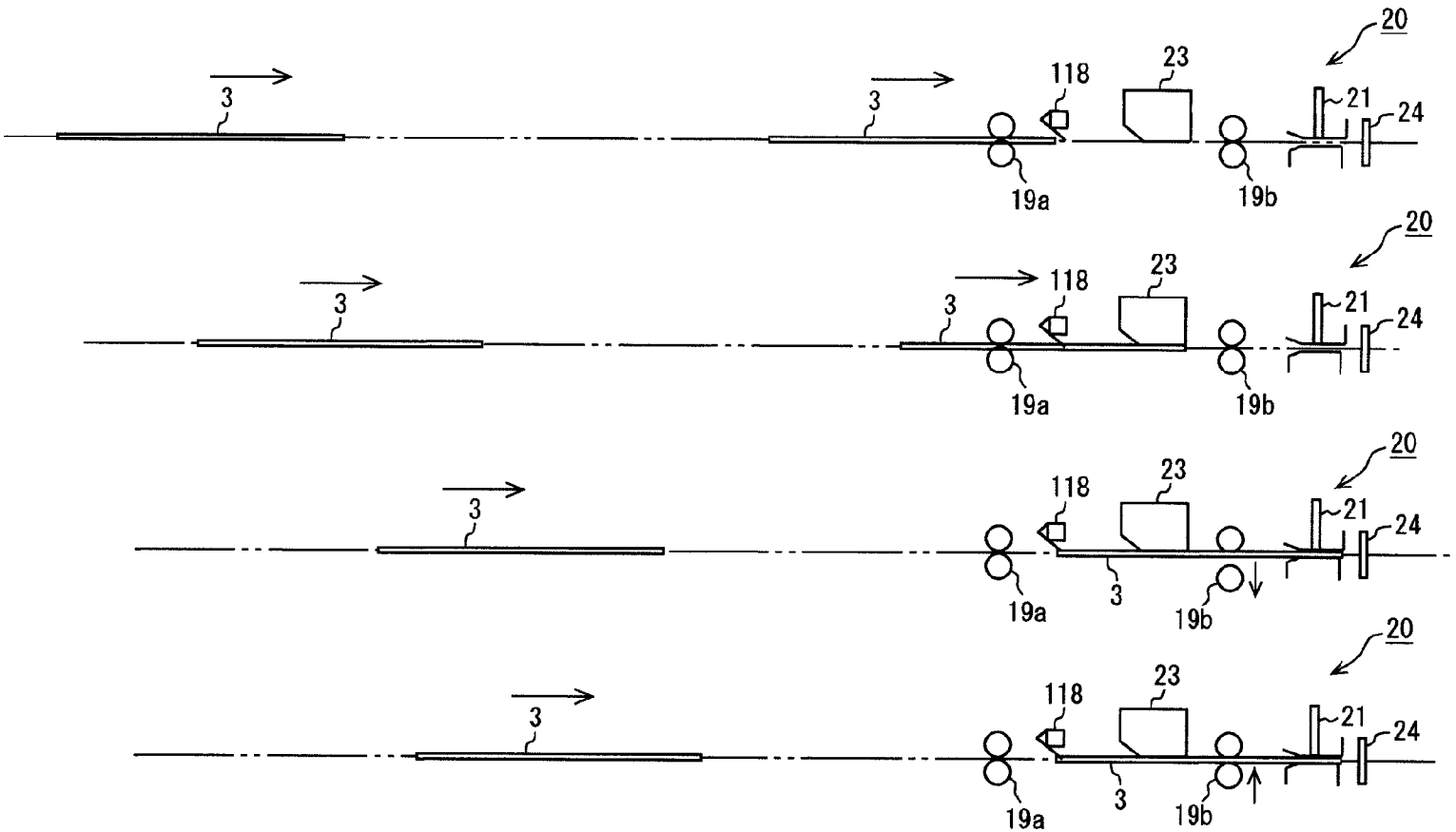
FIGS. 7A to 7D are transition diagrams of a sheet of paper 3 for showing exemplary paper transfer and punch-processing (Part. 1) after the switchback.

Assuming that they constitute the operation conditions, first of all, the top end of the first sheet of paper 3 after the switchback is sensed as in FIG. 7A. In this moment, the paper-sensing sensor 118 senses the reach of the sheet of paper 3 to the punch-processing section 20. The paper-sensing sensor 118 senses the top end of the first sheet of paper 3 and outputs the paper-sensing signal S18 to the control section 50. After sensing the top end of the paper, closure operation of the fence 24 to the first sheet of paper 3 starts. It is configured so that in this moment, the solenoid-driving section 121 receives the solenoid-driving signal S21 from the control section 50 and drives the fence 24 to move downward. As a result, the closure operation of the fence 24 is completed.

Further, after sensing the top end of the sheet of paper as in FIG. 7B, the lateral adjustment of an arrangement of the sheet of paper is performed by the side jogger 23. In this moment, the correction-driving section 119 receives the paper-position-correcting signal S19 from the control section 50 and corrects the position of the sheet of paper 3 in the punch-processing section 20. For example, the correction-driving section 119 laterally moves the side jogger 23 based on the paper-position-correcting signal S19. As a result, the sheet of paper 3 is laterally pressed so that its position can be corrected, and then, the paper-correcting operation by the side jogger 23 is completed as in FIG. 7C.

After completion of the paper correction, the first sheet of paper stops by striking the transfer roller (jog roller) 19*b* against the sheet of paper 3 as in FIG. 7D. For example, the transfer-roller-driving section 117 receives the transfer-driving signal S17 from the control section 50 and releases the transfer roller 19*b* from the driven state based on the transfer-driving signal S17. As a result, the first sheet of paper 3 stops in front of the fence 24.

Figures 8A, 8B, 8C, 8D:
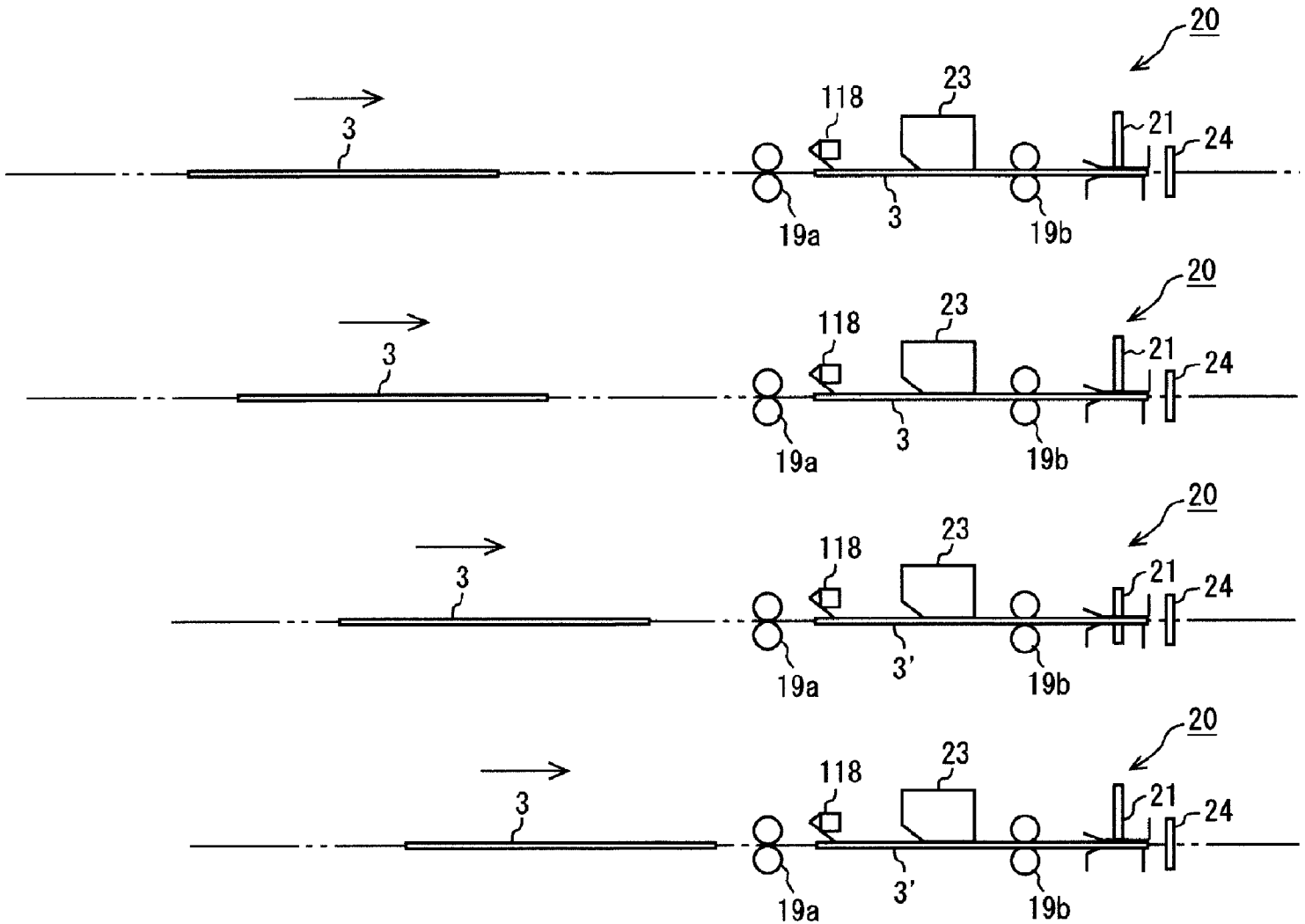
FIGS. 8A to 8D are transition diagrams of the sheet of paper 3 for showing exemplary paper transfer and punch-processing (Part. 2) after the switchback.

Next, the transfer roller 19*b* is driven as in FIG. 8A, and an arrangement of the sheet of paper along the transfer direction thereof and its skew are corrected. In this manner, the positional accuracy of holes on the sheet of paper 3 can be improved. For example, the transfer-roller-driving section 117 receives the transfer-driving signal S17 from the control section 50 and drives the transfer roller 19*b* based on the transfer-driving signal S17. The transfer-roller-driving section 117 then makes the transfer roller 19*b* wait for its driving as in FIG. 8B.

Then, before striking the sheet of paper 3 against the fence 24, the control section 50 controls the transfer-roller-driving section 117 so that the sheet of paper 3 is decelerated. The control section 50 then controls the transfer-roller-driving section 117 to stop the sheet of paper 3 by bring it into contact with the fence 24. Such this control prevents the sheet of paper 3 from being flawed at time of being struck thereagainst.

Next, the punching blades 21 are operated to punch holes on the sheet of paper 3 as in FIG. 8C. It is configured so that in this moment, the motor-driving section 120 receives the motor-driving signal S20 from the control section 50 and moves the punching blades 21 upward and downward in reciprocation manner. Further, the control section 50 controls the transfer-roller-driving section 117 to exert acceleration force to the sheet of paper 3 during the punching operation by the punch-processing section 20. Such this control enables the sheet of paper 3 to be successively hit against the fence 24 at low load during the punching operation. Further, the control section 50 controls the transfer-roller-driving section 117 so as to exert acceleration force again to the sheet of paper 3 during the punching operation by the punch-processing section 20 and to hit the sheet of paper 3 against the fence 24 which is positional reference means. This enables any delay in paper-processing time to be eliminated. In the punch-processing section 20, a predetermined number of holes for binding can be punched at one end of the sheet of paper 3 as shown in FIG. 2.

The fence 24 is then opened as in FIG. 8D, and the transfer thereof starts again. It is configured so that in this moment, the solenoid-driving section 121 receives the solenoid-driving signal S21 from the control section 50 and drives the fence 24 upward. As a result, the operation of opening the fence 24 is completed.

It is configured so that the discharge-roller-driving section 122 then receives the discharge-driving signal S22 from the control section 50 and drives the discharge roller 25. The discharge roller 25 can discharge the sheet of punched paper 3' from the punch-processing section 20. It is configured so that as a result of this processing, the sheet of paper 3' in which the holes for binding are punched is transferred to the binder-paper-aligning unit 30.

Figures 9A, 9B, 9C:
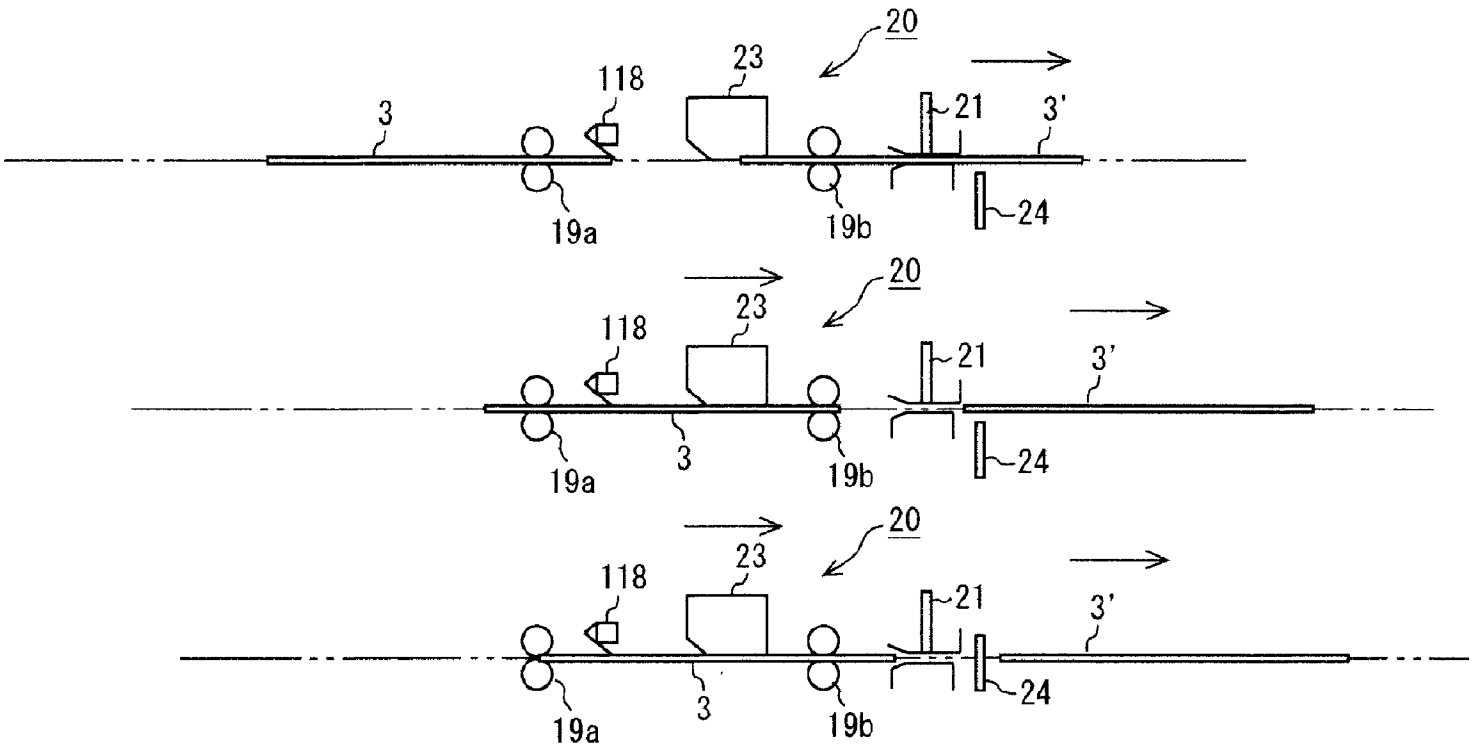
FIGS. 9A to 9C are transition diagrams of the sheet of paper 3 for showing exemplary paper transfer and punch-processing (Part. 3) after the switchback.

It is to be noted that the top end of the second sheet of paper 3 is sensed as in FIG. 9A. At this time, the paper-sensing sensor 118 senses the reach of the second sheet of paper 3 to the punch-processing section 20. The paper-sensing sensor 118 senses the forward end of the second sheet of paper 3 and outputs the paper-sensing signal S18 to the control section 50.

After sensing the top end of the sheet of paper as in FIG. 9B, the closure operation of the fence 24 to the second sheet of paper 3 starts. It is configured so that in this moment, the solenoid-driving section 121 receives the solenoid-driving signal S21 from the control section 50 and drives the fence 24 to move upward. As a result, the closure operation of the fence 24 is completed as in FIG. 9C.

Figure 10:
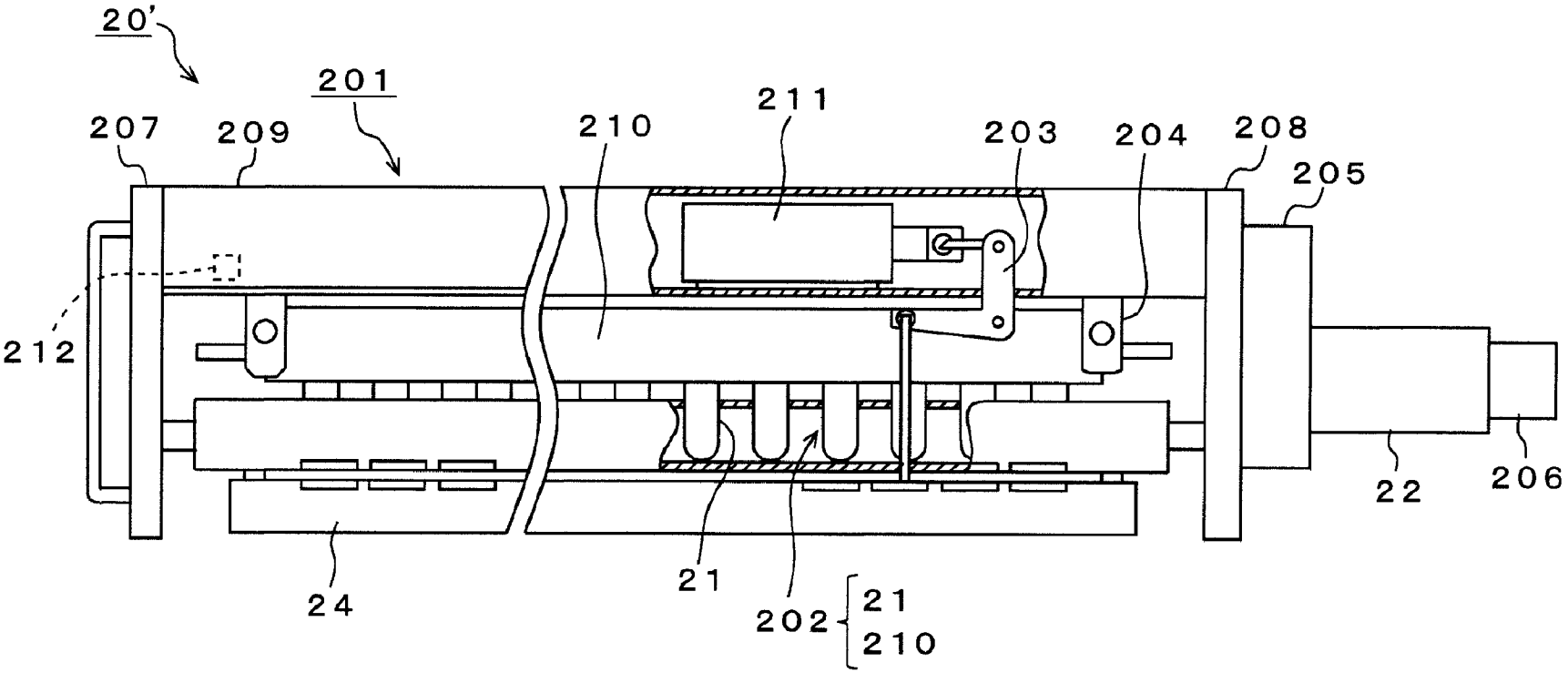
FIG. 10 is a partially exploded side cross-sectional view for showing a configuration of a punch-processing unit 20'.

The following will describe a punch-processing unit 20' that is constituted by arranging the driving system of the punching blades 21 into a form of unit with reference to FIG. 10. The punch-processing unit 20' shown in FIG. 10 is configured to contain the motor 22, the fence 24, a main body section 201, a punching blade unit 202, a link member 203, a driving mechanism 204, a gear unit 205, and an encoder 206.

The main body section 201 has a shape of bridge in which bridging member 209 is supported by a front plate 207 and a back plate 208. The main body section 201 is formed by bending and pressing an iron plate at desired positions. The bridging member 209 has a box shape, and the driving mechanism 204 is provided in the bridging member 209. The driving mechanism 204 is constituted by the motor 22, a linkage member (not shown), and the gear unit 205. The punching blade unit 202 is mounted to the driving mechanism 204. For example, the punching blade unit 202 contains a body section 210 to which a plurality of punching blades 21 are attached in line. The body section 210 is movably mounted to the linkage member of the driving mechanism 204.

The gear unit 205 contains a gear and a lack gear, not shown. The motor 22 is engaged with the gear, and the gear is engaged with the lack gear, so as to convert the rotating motion of the motor 22 into an upward and downward movement in reciprocation manner. Driving force of the lack gear upward and downward in reciprocation manner drives the body section 210 via the linkage member described above. As a result, the driving mechanism 204 is configured as to drive the punching blade unit 202 upward and downward in reciprocation manner. This enables a predetermined number of holes to be punched on the sheet of paper 3 having a predetermined thickness.

On top of the linkage member of the driving mechanism 204, a solenoid 211 is disposed inside the bridging member 209 described above. A link member 203 is movably mounted to the solenoid 211. The fence 24 is mounted to the other end of the link member 203. The fence 24 has a shape of elongated plate having a length larger than that of the sheet of paper 3, in which a reference position for the punching blades relative to the sheet of paper 3 is set. The fence 24 is disposed below the punching blade unit 202. It is configured so that the link member 203 drives the fence 24 to move upward and downward (gate open/close operation) based on the reciprocation movement by the solenoid 211.

An encoder 206 is engaged with the motor 22 described above, for detecting the rotational speed of the motor shaft and outputting a speed-detecting signal (speed-detecting information) S23. It is configured so that inside the bridging member 209, a position sensor 212 is disposed and is at a regular position, where it senses the punching blade unit 202 and outputs a position-detecting signal S24 indicating whether or not the unit 202 has returned to its home position. Thus, the punch-processing unit 20' is constituted.

Figure 11:
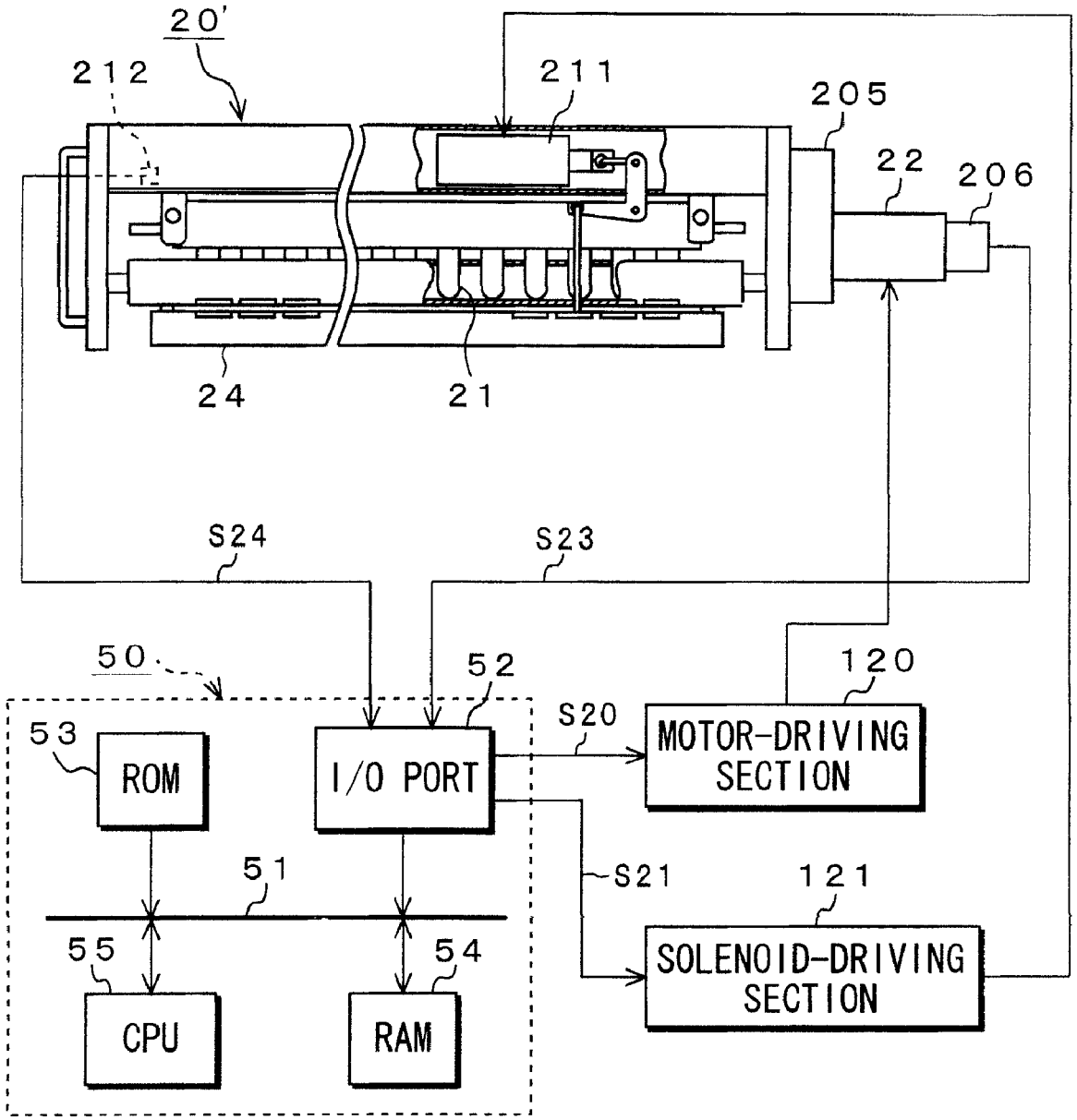
FIG. 11 is a block diagram for showing a configuration of a control system of the punch-processing unit 20'.

A configuration of a control system for the punch-processing unit 20' is shown in FIG. 11. The control system for the punch-processing unit 20' shown in FIG. 11 is constituted to contain the control section 50, the motor-driving section 120, and the solenoid-driving section 121.

The control section 50 contains a system bus 51. To the system bus 51, an I/O port 52, an ROM 53, an RAM 54, and a CPU 55 are connected. The position sensor 212 is connected to the I/O port 52, for detecting a fixed position of the punching blades 21 (hereinafter, referred to as their home position HP) and outputting the position-detecting signal S24. As the position sensor 212, a transmission-type optical sensor is employed. To the I/O port 52, the encoder 206 as an example of speed sensor is connected on top of the position sensor 212, for detecting the speed of the punching blades 21 in its return route and outputting the speed-detecting signal S23.

For example, a program for calculating a reverse damping amount (hereinafter, referred to as a reverse braking retention time Y) is stored in the ROM 53. The RAM 54 is used as a work memory at the time of calculating the reverse braking force retention time Y. A general purpose memory is used as the RAM 54, for temporarily storing the data in the course of the computation.

The CPU 55 calculates the reverse braking force retention time Y based on the speed-detecting signal S23 when the punching blades 21 return, and executes motor reverse braking control based on the reverse braking retention time Y when it detects the regular position of the punching blades 21. The speed-detecting signal S23 when the punching blades 21 are returned is acquired from the encoder 206. The CPU 55 controls the punching blades 21 to stop at their home positions HP based on the position-detecting signal S24 of the punching blades 21 outputted from the position sensor 212 and the reverse braking retention time Y.

In this embodiment, defining the period of time when the punching blades 21 pass through a specific section when they return as X, constants as α and β, and the reverse braking force retention time as Y, the CPU 55 calculates an equation (1), that is:

$$Y=\alpha X+\beta \quad (1)$$

α is a constant which takes a minus value and has a relation such that the smaller the value of X becomes, the larger the value Y becomes.

It is configured so that the motor-driving section 120 receives the motor-driving signal S20 from the CPU 55 via the I/O port 52 and drives the motor 22 based on this motor-driving signal S20 to move the punching blade unit 202 upward and downward in reciprocation manner via the driving mechanism 204. It is configured so that the solenoid-driving section 121 receives the solenoid-driving signal S21 from the CPU 55 and drives the solenoid 211 based on this solenoid-driving signal S21 to drive the fence 24 to move upward and downward.

Figures 12A, 12B, 12C, 12D:
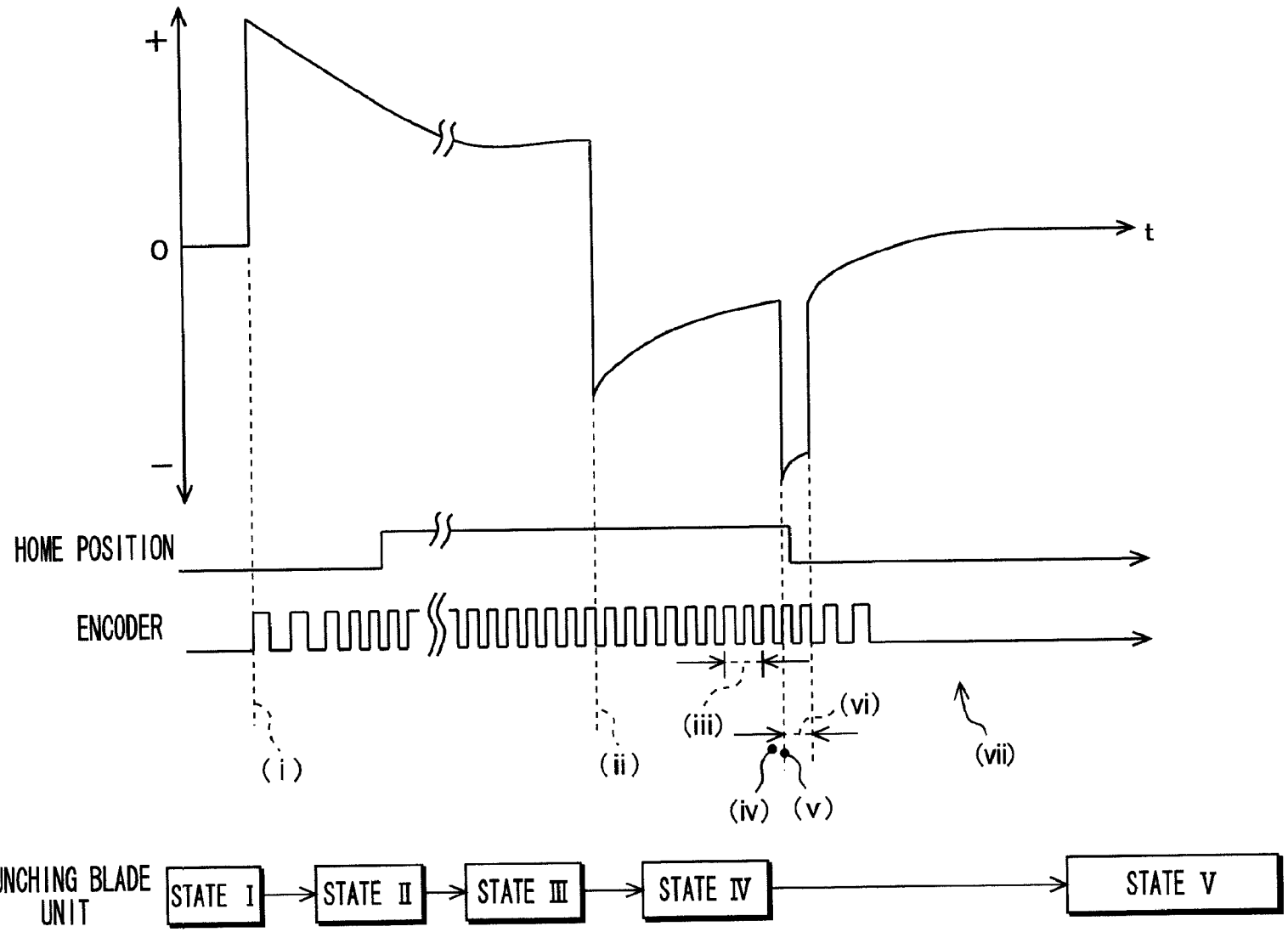
FIGS. 12A to 12D are waveform diagrams each for showing an exemplary control by a motor 22.

An example of controls exerted to the motor 22 and an example of states of the punching blade unit 202 are shown in FIGS. 12A to 12D. The example of states of the punching blades 21 thereof is shown in FIGS. 13A to 13E. In this embodiment, the state I shown in FIG. 12D is a case where the punching blade unit 202 is at its home position (see FIG. 13A).

An exemplary driven state of the motor 22 is shown in FIG. 12A. In FIG. 12A, when the motor 22 starts at a position (i), the load (the punching blade unit 202) at the time when it is activated is heavy, and its waveform suddenly rises, and then, the load gradually reduces so that the waveform mildly decreases. It is configured so that in this moment, at the state II shown in FIG. 12D, the punching blade unit 202 starts to pass through the sheet of paper 3 from the left side thereof (see FIG. 13B).

At the state III, the punching blade unit 202 then finishes passing through the sheet of paper 3. In this moment, the punching blade unit 202 reaches the lowermost position thereof (see FIG. 13C). The punching blades 21 then enter into their return route. At this time, the punching blade unit returns from the left side at the state IV shown in 12D to its home position (see FIG. 13D, 13E). The motor 22 is then subjected to a first short brake control at the position (ii) shown in FIG. 12A.

An exemplary detection of the home position by the position sensor 212 is shown in FIG. 12B. The position-detecting signal S24 shown in FIG. 12B indicates a case where the punching blade unit comes out from its home position HP at a high level thereof (hereinafter, referred to as "H" level). Alternatively, it indicates a case where the punching blade unit 202 stays at its home position HP at a low level thereof (hereinafter, referred to as "L" level).

An exemplary speed detection performed by the encoder 206 is shown in FIG. 12C. The encoder 206 outputs the speed-detecting signal S23 obtained during when the motor 22 is rotating to the CPU 55. The speed-detecting signal S23 has a wide pulse period when the rotation speed of the motor 22 is low, and has a short pulse period when the rotation speed of the motor 22 is high.

The CPU 55 samples the speed-detecting signal S23 obtained after the first short brake control is exerted. During the period of this short brake, a speed-detecting signal S23 obtained at the time when the punching blades return to their home positions detected by the encoder 206 at the position (iii) is input. The CPU 55 calculates the reverse brake retention time Y based on the speed-detecting signal S23 utilizing the equation (1) described above at the position (iv).

The CPU 55 executes motor reverse brake control at the position (v) based on the reverse brake retention time Y obtained as a result of calculation here. As a result of this control, the motor 22 becomes possible to generate strong damping force in the retention time at the position (vi).

Embodiment 2

In a second embodiment 2, successive to the motor reverse brake control described above, the CPU 55 executes a second short brake control to the motor 22 at the position (vii). As a result of controlling the motor 22 in this manner, when the speed of the punching blade unit 202 on its return route is faster than the reference speed, it becomes possible to stop the punching blade unit 202 at its home position HP with brake force stronger than the reference brake force while when the speed of the punching blade unit 202 on its return route is slower than the reference speed, it becomes possible to stop the punching blade unit 202 at its home position HP with brake force weaker than the reference brake force. It is to be noted that at the state V shown in FIG. 12D, the punching blade unit 202 returns to its home position (see FIG. 13E). It is configured so that in this manner, the punching blades 21 are driven into the wave state to punch holes on the sheet of paper 3.

An example of stroke of the punching blades in the punching blade unit 202 in one cycle is shown in FIGS. 14A to 14F.

Figures 14A, 14B, 14C, 14D, 14E, 14F:
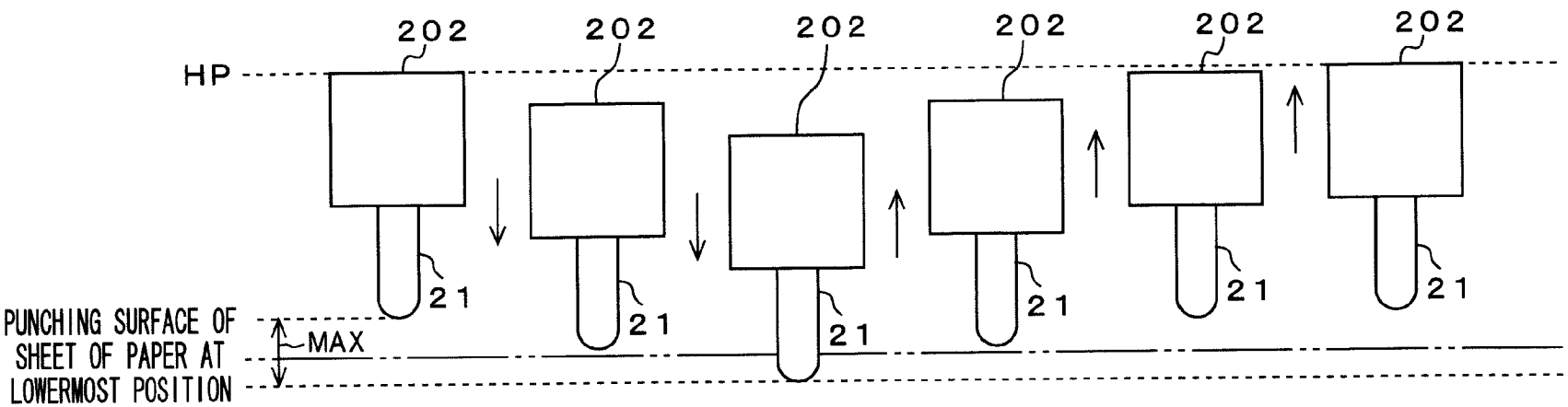
FIGS. 14A to 14F are diagrams each for showing an exemplary punching blade stroke of one cycle in a punching blade unit 202.

The punching blade unit 202 shown in FIG. 14A stays in a stand-by (positioned) state at its home position HP. The punching blade unit 202 shown in FIG. 14B stays in a state where the motor 22 is turned on to move downward from its home position HP toward the paper-punching surface. The punching blade unit 202 shown in FIG. 14C stays in a state where it passes through the paper-punching surface and reaches to the lower most position thereof. When the paper-punching surface is passed through, the holes for binding are punched at one end of the sheet of paper 3. Max in the drawing indicates the maximum stroke of the punching blade unit 202.

The punching blade unit 202 shown in FIG. 14D stays in a state where it escapes from the lowermost position thereof and moves upward to its home position HP passing through the punching surface of the sheet of paper. During this upward movement, the CPU 55 receives the speed-detecting signal S23 obtained while the punching blades are returning and detected by the encoder 206, and calculates the reverse brake retention time Y based on this speed-detecting signal S23.

The punching blade unit 202 shown in FIG. 14E stays in a state immediately before its home position is detected. At this time, the motor reverse brake control is exerted based on the reverse brake retention time Y which has already been calculated and obtained beforehand. In this manner, the punching blade unit 202 can stop always within its home position. The punching blade unit 202 shown in FIG. 14F stays in a state where it stops at its home position HP, and is ready for the punch-processing for the next sheet of paper 3.

Embodiment 3

Figures 15A, 15B, 15C:
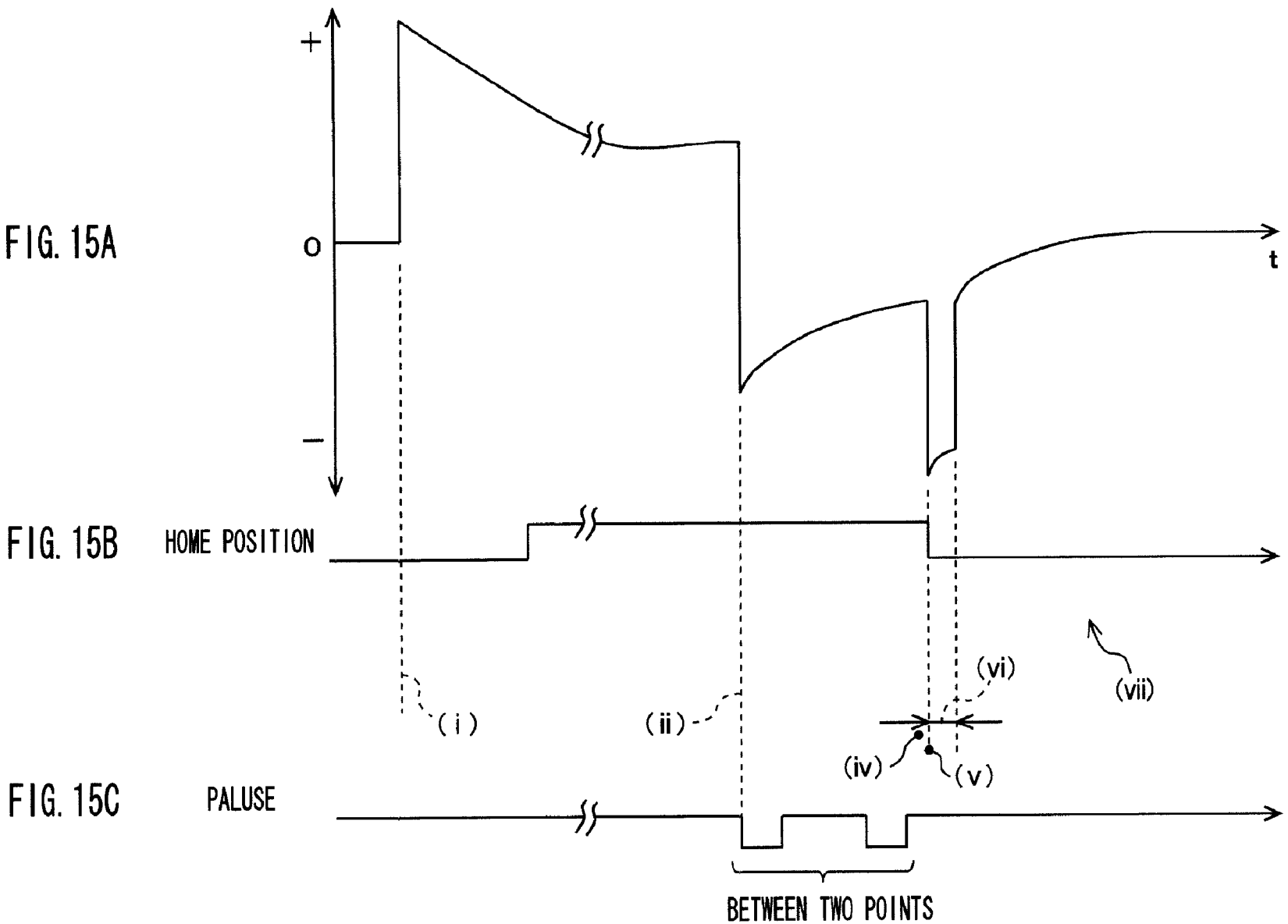
FIGS. 15A to 15C are waveform diagrams each for showing an exemplary control by a motor 22 as a third embodiment.

An example of controls exerted to the motor 22 according to a third embodiment is shown in FIGS. 15A to 15C. In FIG. 15A, an exemplary driving operation exerted to the motor 22 same as that shown in FIG. 12A is illustrated. In FIG. 15B, an exemplary detection of home position performed by the position sensor 212 same as that shown in FIG. 12B is illustrated.

The pulse waveform shown in FIG. 15C is obtained as follows. First of all, a time difference is obtained between the points of time when the punching blade unit 202 pass through arbitrary two points after a predetermined time has elapsed since a first short brake controls has been started. Next, speed information is obtained from this time difference. When this method of obtaining the speed information is employed, the encoder 206 can be eliminated.

As described above, according to the binding apparatus and the paper-processing method as the first to third embodiments, when punching holes on a sheet of predetermined paper 3 to discharge it, the paper-transferring section 10 contains the transfer path 11 for transferring the sheet of paper toward the switchback position and the transfer path 12 to which the transfer route can be switched from the transfer path 11. On this assumption, the control section 50 controls the paper-transferring section 10 and the punch-processing section 20. The control section 50 controls the paper-transferring section 10 so as to decelerate and stop the transfer of the sheet of paper 3 at a predetermined position on the transfer path 11, to switch the transfer route of the sheet of paper 3 from the transfer path 11 to the transfer path 12, and to deliver the sheet of paper 3 in a reverse direction thereof.

Therefore, the sheet of paper 3 can be transferred from the transfer path 11 to the punch-processing section 20 with the sheet-shaped figure of the sheet of paper 3 kept as it is. Thereby, it becomes possible to prevent the sheet of paper 3 from deforming in a rolled shape, so that the holes for binding can be punched at one end of the sheet of paper 3 at the punch-processing section 20. Thus, the binding apparatus 100 having a paper transfer route in the shape of the letter V laid sidelong can be provided alternatively to a reverse transfer route for reversing the sheet of paper 3 as if it is rolled around the transfer roller. Further, high positional accuracy of the holes can be achieved, the period of processing time can be shortened, and minute flaws can be prevented, thereby providing a booklet 90 with high quality.

It is to be noted that in a finisher of a conventional scheme, sheets of paper 3 have been fed with their surface faced down, and the sheets of paper have been bound into a booklet with a staple and the like after the sheets of paper have been aligned to one another. In the present invention, when the binding apparatus 100 is located at a midpoint between the copying machine and the finisher, it becomes possible to process a sheet of printed paper in the same direction as of the conventional paper discharging direction.

Thus, complicated software processing such as converting the direction of printing data is not needed any more in the copying machine, and therefore, memory in the copying machine can be reduced and the period of time required for software development can be shortened. Further, the sheet of paper is switched back upon increasing the paper-feeding speed during the through-pass operation, so that the size for the apparatus main body section 101 can be saved.

Embodiment 4

Figure 16:
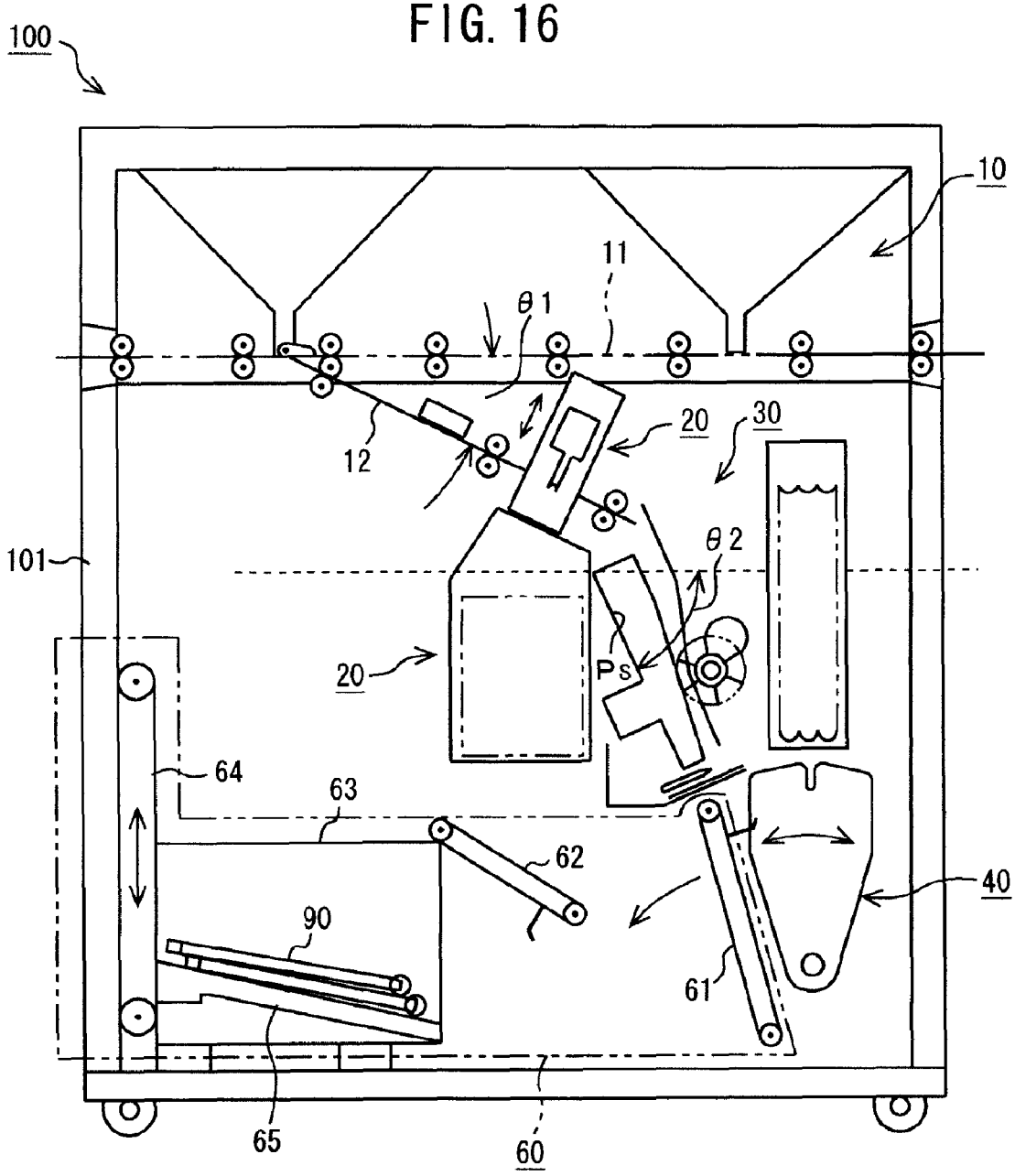
FIG. 16 is a diagram for complementing an exemplary arrangement of a punch-processing section 20 and a binder-paper-aligning unit 30 as a fourth embodiment.

An example of an arrangement of a punch-processing section 20 and a binder-paper-aligning unit 30 as a fourth embodiment according to the present invention is shown in FIG. 16. In this embodiment, punching means disposed in such a manner that its paper-punching surface is set at a position having a first depression angle θ1 relative to the transfer surface of the paper-transferring means, and paper-retaining means disposed in such a manner that its paper-retaining surface is set at a position having a second depression angle θ2 relative to the transfer surface of the paper-transferring means are provided. The relationship between the first depression angle and the second depression angle is set to satisfy θ1<θ2. It is configured so that in transferring a sheet of paper from the punching means to the paper-retaining means, the own-weight drop of the sheet of paper can be utilized in a gravity direction of the sheet of paper and the paper can be linearly moved so that a moving distance of the sheet of paper can be set to short.

In the embodiment shown in FIG. 16, the transfer path 11 and the transfer path 12 are designed to have a predetermined angle therebetween. For example, the first depression angle θ1 is set between the transfer surface of the transfer path 11 and the paper-punching surface in the punch-processing section 20. Here, the paper-punching surface refers to as a surface on which the sheet of paper 3 is punched. The punch-processing section 20 is disposed in such a manner that its paper-punching surface is set at a location having the depression angle θ1 relative to the transfer surface of the transfer path 11.

The binder-paper-aligning unit 30 is disposed in such a manner that its paper-retaining surface is set at a location having the second depression angle θ2 relative to the transfer surface of the transfer section 11. Here, the paper-retaining surface refers to as a surface on which the sheets of punched paper 3 are retained (stacked). In this embodiment, the relationship between the depression angle θ1 and the depression angle θ2 is set to satisfy θ1<θ2. This setting is intended to reduce the width of the apparatus body device 101 and to transfer the sheet of paper 3 linearly under these conditions. In this embodiment, the depression angle θ1 is at about 25°, and the depression angle θ2 is at about 65 to 70°.

Further, unlike a conventional scheme where the punch-processing section 20 is disposed on a through-pass route, the punch-processing section 20 is disposed on the binder route along which the sheet of paper 3 moves (passes) by only a minimum needed distance (size, number) and the sheet of paper 3 is moved from the through-pass route to the binder-paper-aligning unit 30 through the reverse route and the punch-processing section 20 as well as the booklet (a bundle of sheets of paper) 90 is moved from the discharge unit 60 to the stacker 63 after the binding operation, so that all of them are configured linearly.

When the transfer routes of the sheets of paper 3 and the booklet 90 are thus configured linearly, it is possible to reduce the moving distance to minimum and to reduce occurrence of jamming of the sheets of paper 3, thereby enabling reliability to be increased.

It is to be noted that in the discharge unit 60 shown in FIG. 16, a belt-driving section 64 is disposed at a left side of the apparatus main body section (housing) 101, for assuring an amount of movement of the belt of the lifting portion 65 within the stacker 63. It is configured so that the lifting portion 65 is mounted to the belt-driving section 64, for moving (lifting) up each of the booklets 90 stacked in the stacker 63 to a predetermined discharge port.

Figure 17:
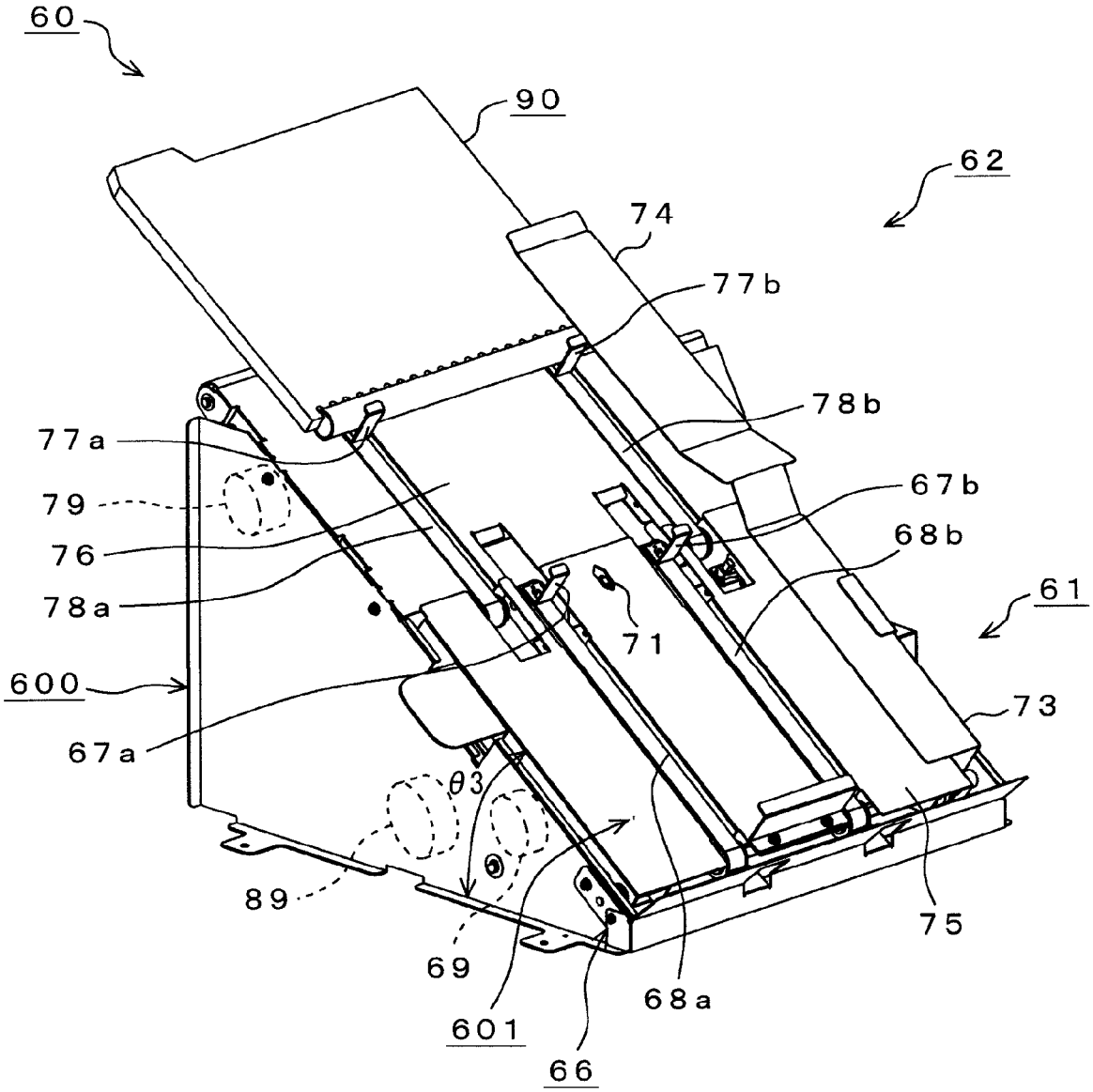
FIG. 17 is a perspective view for showing a configuration of a discharge unit 60.

A configuration of the discharge unit 60 is shown in FIG. 17. It is configured so that the discharge unit 60 shown in FIG. 17 is disposed at the downstream side of the bind-processing section 40, for receiving the booklet (s) 90 created by the bind-processing section 40 and perform discharge processing thereon. In FIG. 17, illustration of the stacker 63 is omitted. The discharge unit 60 is configured to contain, for example, a first belt unit 61, a second belt unit 62, and a main body stand section 600.

The main body stand section 600 has a housing structure containing an inclined portion (slope) 76. In this embodiment, an inclined angle θ3 is set between the booklet transfer surface of the inclined portion 76 and a bottom surface of the main body stand section 600. The inclined angle θ3 is at about 30°. The main body stand section 600 is formed by cutting, pressing, and bending a metal plate (such as an iron plate) into predetermined shapes of back plate, side plates, base plate of the inclined section and the like, as well as combining them.

The belt unit 61 is movably engaged with the main body stand section 600, receives the booklet 90 fallen from the bind-processing section 40 with reference to a predetermined support point, and after that, switches the delivery direction thereof. The belt unit 61 is configured to contain, for example, a rotation mechanism section 66, claws 67*a* and 67*b*, a pair of belts 68*a* and 68*b*, a motor 69, a booklet sensor 71, an inclined portion 75, and a movable main body section 601.

It is configured so that the movable main body section 601 having a predetermined shape is movably engaged with the main body stand section 600, and is rotatable only by a predetermined angle about a predetermined support point. The movable main body section 601 contains the inclined portion 75, and the inclined portion 75 constitutes the booklet transfer surface. The movable main body section 601 is formed by cutting, pressing, and bending a metal plate (such as an iron plate) into predetermined shapes of back plate, side plates, base plate of the inclined section and the like, and combining them.

In this embodiment, two endless belts 68*a* and 68*b* are arranged in parallel to each other to extend along the inclined surface of the movable main body section 601 at the positions dividing the booklet transfer surface thereof equally into three segments. The belts 68*a* and 68*b* are engaged with a rotational driving shaft (belt drive shaft). The rotational driving shaft is rotatably mounted in the movable main body section 601 at its predetermined position. It is configured so that the belts 68*a*, 68*b* move upward or downward by driving the belt drive shaft by the motor 69.

It is configured so that the claw 67*a* is attached to the belt 68*a* whereas the claw 67*b* is attached to the belt 68*b*, respectively, for catching the booklet 90 fallen from the bind-processing section 40 on the booklet transfer surface. A booklet sensor 71 is attached above the inclined portion 75, for sensing the booklet 90 which is falling from the bind-processing section 40 to output a booklet-sensing signal S71. The booklet-sensing signal S71 is used as a trigger signal for controlling the motor.

The number of steps of the motor 69 is counted by using the booklet-sensing signal S71 as its trigger, and it is sensed that the claws 67*a* and 67*b* holding the booklet 90 have reached to lowermost position. It is to be noted that at one side of the above-mentioned inclined portion 75, a guide plate 73 is provided and is used to guide the booklet 90 when falling it and then pushing it up.

The rotation mechanism section 66 contains a motor 89, a driving arm 83 (see FIG. 19A), and a gear unit, which is not shown, and operates so that the rotational speed of the motor 89 is decreased by the gear of the gear unit and the movable main body section 601 rotates only by a predetermined angle by the driving arm 83. For example, the rotation mechanism section 66 operates the movable main body section 601 to start its rotation toward the belt unit 62 at a second position where the booklet 90 is moved down to the lowermost position.

The rotation mechanism section 66 rotates from the second position described above to a position where the booklet transfer surface of the belt unit 61 and the booklet transfer surface of the belt unit 62 are in flush with each other. At the point of time when both booklet transfer surfaces are in flush with each other, the booklet 90 described above is transferred to the second belt unit 62 as if it is pushed up along the inclined portion 75. It is configured so that a position sensor 85 is disposed to the rotation mechanism section 66, for sensing the home position of the movable main body section 601 and outputting a position-sensing signal S85.

The belt unit 62 is disposed on the inclined portion 76 of the main body stand section 600. The inclined portion 76 having a predetermined shape is mounted to the main body stand section 600 and has a booklet transfer surface. It is configured so that the belt unit 62 receives a booklet 90 whose delivery direction has been switched by the belt unit 61, and transfers it to the stacker 63.

The belt unit 62 is configured to contain, for example, a booklet sensor 72 (see FIG. 21), claws 77*a* and 77*b*, a pair of belts 78*a* and 78*b*, and a motor 79. In this embodiment, two endless belts 78*a* and 78*b* are arranged in parallel to each other along the booklet transfer surface of the inclined portion 76. The belts 78*a* and 78*b* are arranged at positions as to put the top ends of two belts 68*a*, 68*b* of the belt unit 61 therebetween. The belts 78*a* and 78*b* are engaged with a rotation-driving shaft (belt-driving shaft). The rotation-driving shaft is rotatably mounted in the main body stand section 600 at its predetermined position. It is configured so that the belts 78*a*, 78*b* are driven to move upward or downward by driving the belt-driving shaft by the motor 79.

It is configured so that the claw 67*a* is attached to the belt 68*a* whereas the claw 67*b* is attached to the belt 68*b*, respectively, for catching the booklet 90 fallen from the bind-processing section 40 on the booklet transfer surface. A booklet sensor 71 is attached above the inclined portion 75, for sensing the booklet 90 which is falling from the bind-processing section 40 to output a booklet-sensing signal S71. The booklet-sensing signal S71 is used as a trigger signal for controlling the motor.

In this embodiment, a predetermined distance is set between the position where the claws 77*a* and 77*b* of the belt unit 62 are in a stand-by state and the position where the claws 77*a* and 77*b* get butted against the booklet 90. It is configured so that, for example, the claws 77*a* and 77*b* are in a stand-by state at the back side of the booklet transfer surface and when the booklet sensor 71 has detected the rear end of the booklet, they move by a predetermined distance to appear at the front side of the booklet transfer surface.

Stepping motor is used as each of the motors 69 and 79 and the motor 89 of the rotation mechanism section, which have been described above. These motors 69, 79, and 89 are controlled by a motor-driving section 70. For example, the motor-driving section 70 controls the belts 78*a* and 78*b* in such a manner that, after the booklet 90 has passed a third position P3 on the belt unit 61, the claws 77*a* and 77*b* of the belt unit 62 move upward while pushing up the rear end of the booklet 90.

Figure 18:
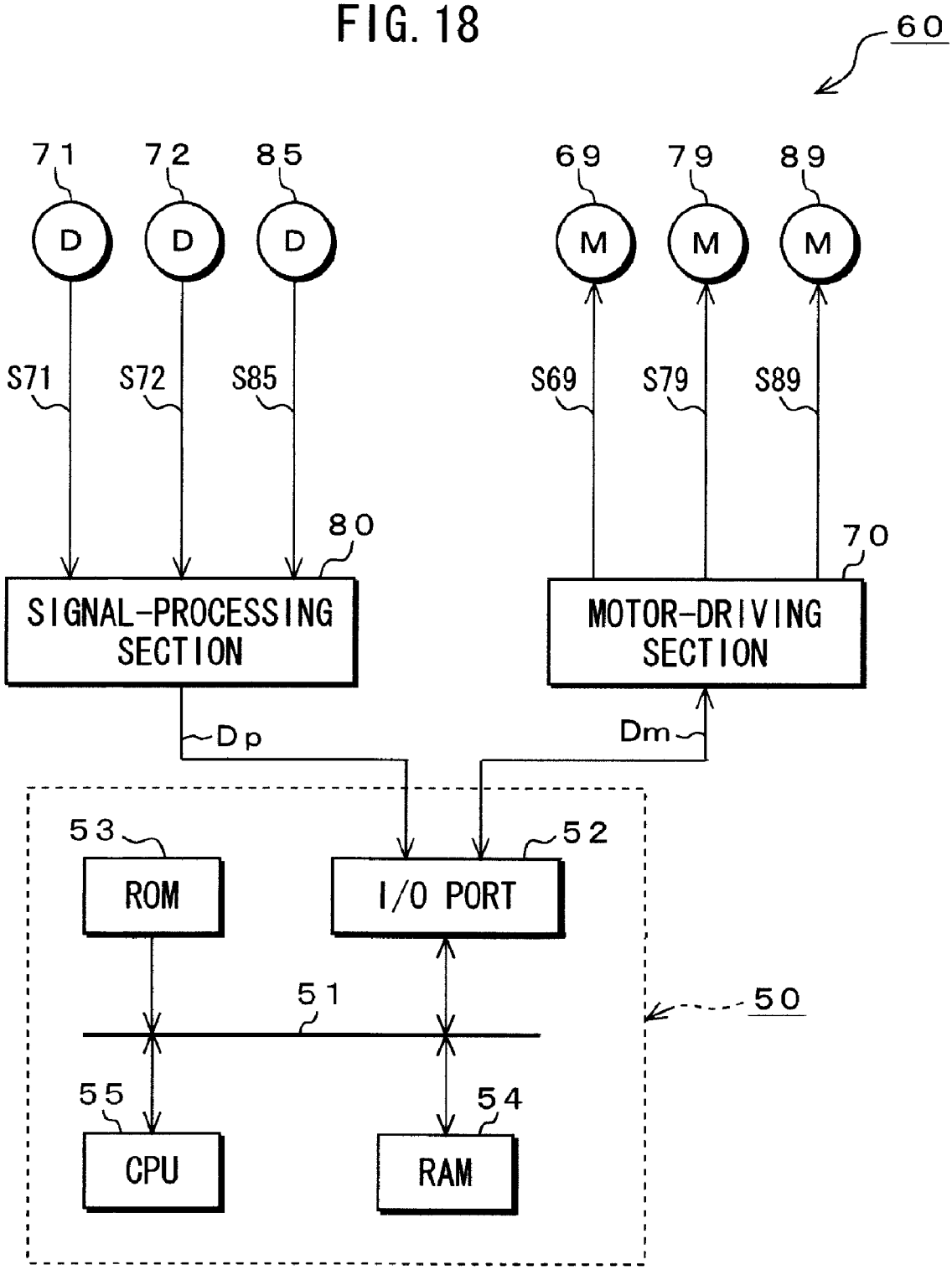
FIG. 18 is a block diagram for showing a configuration of a control system of the discharge unit 60.

A configuration of a control system for the discharge unit 60 is shown in FIG. 18. The control system for the discharge unit 60 shown in FIG. 18 is configured to contain the control section 50, the motor-driving section 70, and a signal-processing section 80. The control section 50 contains the system bus 51. To the system bus 51, the I/O port 52, the ROM 53, the RAM 54, and the CPU 55 are connected. In the ROM 53, for example, a program for performing any discharge control on the booklet 90 (booklet discharge control program) is stored. The RAM 54 is used as a work memory at the time when performing the discharge control on the booklet 90 based on the booklet discharge control program. It is configured so that a general purpose memory is employed as the RAM 54, for temporarily storing the reference value for comparison for controlling the motors and the number of steps of the stepping motors.

To the I/O port 52, the motor-driving section 70 and the signal-processing section 80 are connected. To the signal-processing section 80, three sensors, that is, the booklet sensors 71 and 72 and the position sensor 85 are connected. A reflection-type optical sensor is employed as each of the sensors 71, 72, and 85. The booklet sensor 71 senses the booklet 90 fallen from the bind-processing section 40, and outputs the booklet-sensing signal S71 to the signal-processing section 80. The position sensor 85 senses a regular position (hereinafter, referred to as a home position) of the movable main body section 601, and outputs the position-sensing signal S85 to the signal-processing section 80. The booklet sensor 72 senses the booklet 90 discharged to the stacker 63 and outputs the booklet-sensing signal S72 to the signal-processing section 80. The signal-processing section 80 binarizes (digitizes) each of the signals S71, S72, and S85 into, for example, three-bit positional detection data Dp, and outputs it to the CPU 55.

At the time of reset, the CPU 55 stops the movable main body section 601 at its home position HP, and waits for the positional detection data Dp at the time when the booklet is received from the signal-processing section 80. When receiving the positional detection data Dp at the time when the booklet is received from the signal-processing section 80, the CPU 55 controls the motor-driving section 70 based on the positional detection data Dp and executes booklet discharge control.

To the motor-driving section 70, the motor 69 provided in the belt unit 61, the motor 79 provided in the belt unit 62, and the motor 89 provided in the rotation mechanism section 66, respectively, are connected. For example, 3-bit motor control data Dm based on the booklet discharge control program and the positional detection data Dp is inputted from the CPU 55 into the motor-driving section 70.

The motor-driving section 70 receives motor control data Dm from CPU 55 via the I/O port 52, drives three motors 69, 79, and 89 based on this motor control data Dm, and in turn, drives the belt unit 61, the belt unit 62, and the rotation mechanism section 66. The motor-driving section 70 outputs a motor drive signal S69 obtained by decoding the motor control data Dm to the motor 69, outputs a similarly decoded motor drive signal S79 to the motor 79, and outputs a similarly decoded motor drive signal S89 to the motor 89, respectively. As a result, it becomes possible for the motor-driving section 70 to control the motor 69 of the belt unit 61, the motor 89 of the rotation mechanism section 66, and the motor 79 of the belt unit 62, respectively, based on the outputs from the booklet sensors 71 and 72 and the output from the position sensor 85.

Figure 20A:
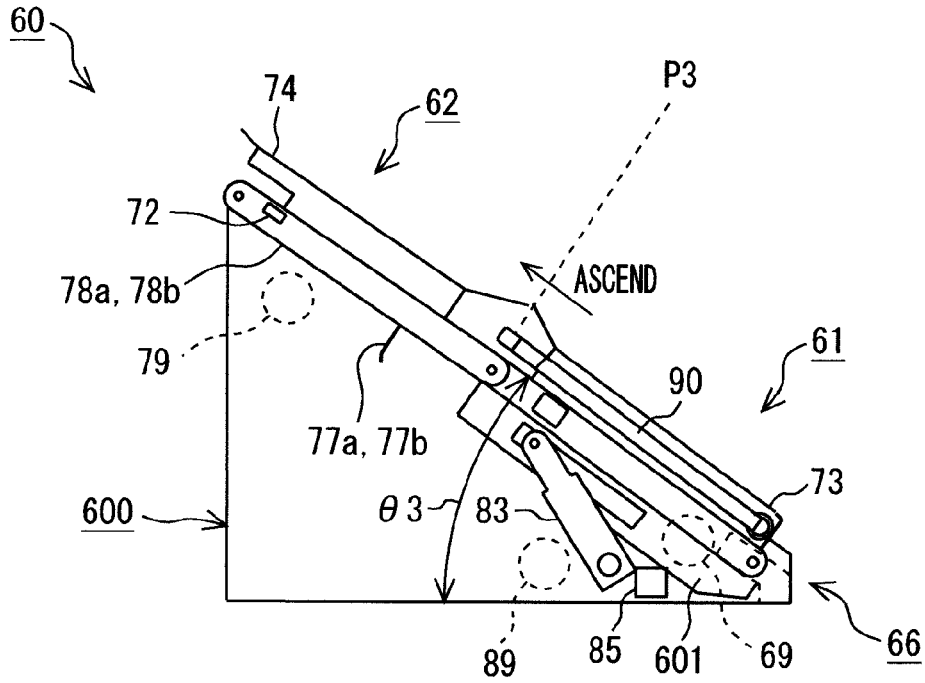
FIGS. 20A and 20B are transition diagrams each for showing an exemplary operation (Part. 2) performed in the discharge unit 60.
Figure 20B:
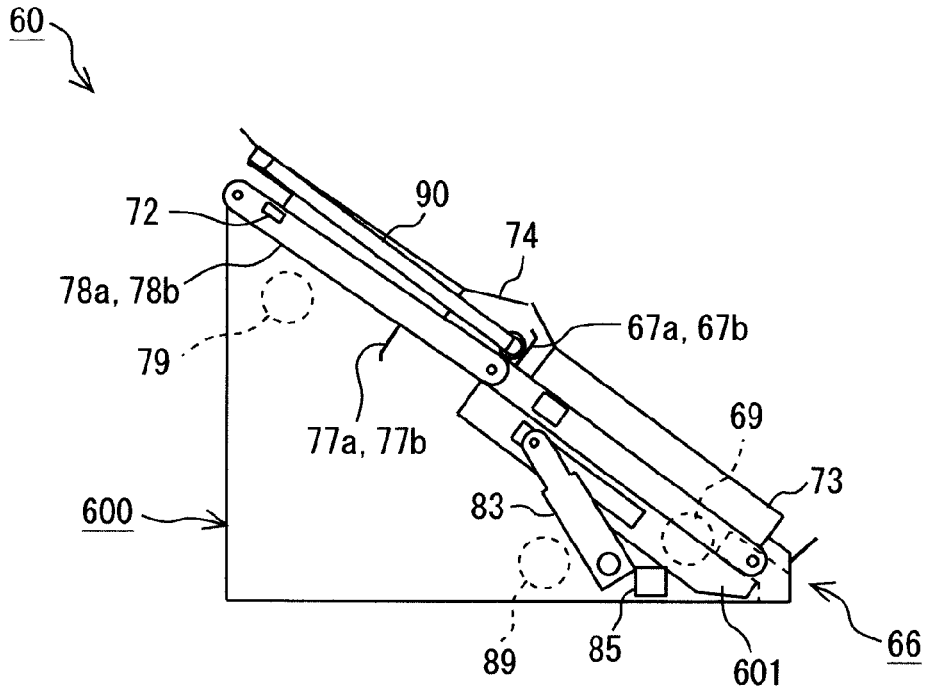
Figure 21:
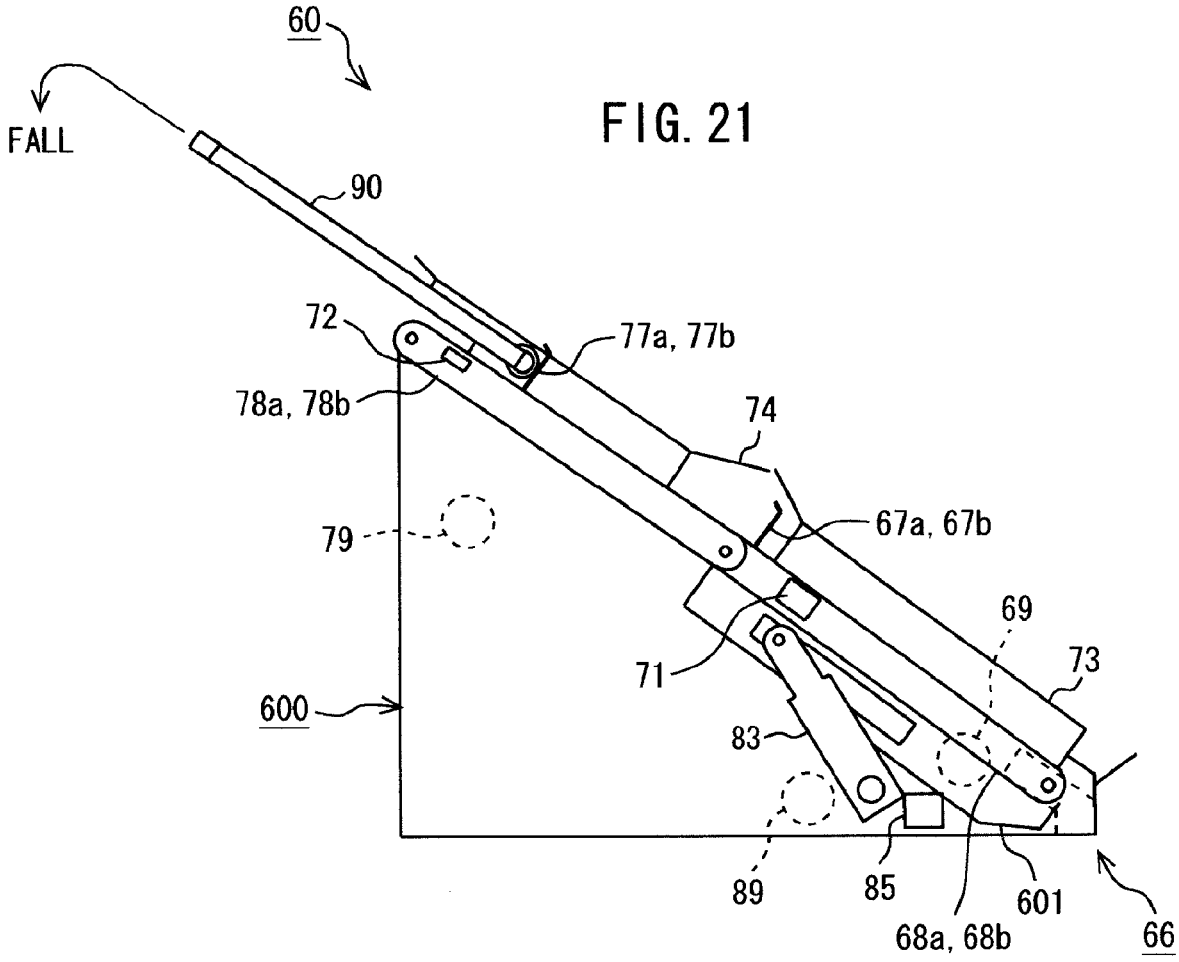
FIG. 21 is a transition diagram for showing an exemplary operation (Part. 3) performed in the discharge unit 60.

Exemplary operations (Nos. 1 to 3) of the discharge unit 60 are shown in FIGS. 19 to 21. In this embodiment, an exemplary case where the motor-driving section 70 controls the belts 68*a* and 68*b* to move based on a first position P1 where the booklet 90 is received from above, a second position P2 where the booklet 90 is moved downward to the lowermost position thereof, and a third position P3 where the booklet 90 is pushed up to the belt unit 62 and is relayed to the belt unit 62 is illustrated.

Figure 19A:
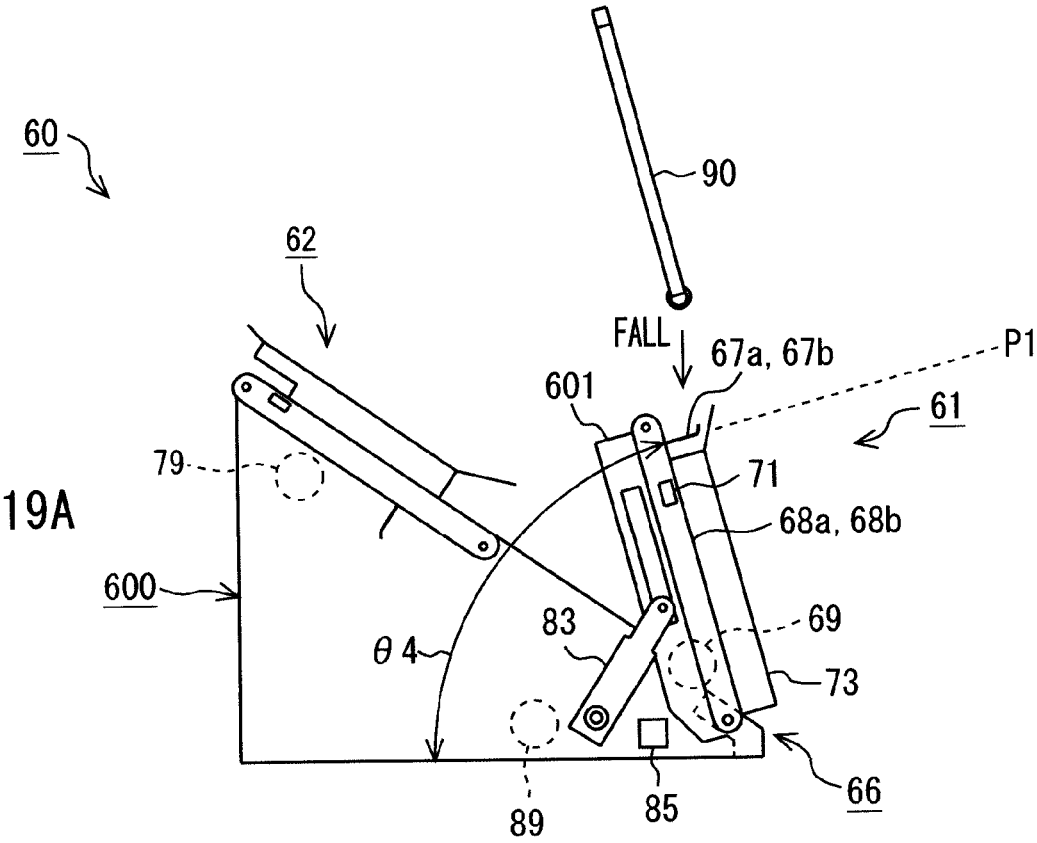
FIGS. 19A and 19B are transition diagrams each for showing an exemplary operation (Part. 1) performed in the discharge unit 60.

An example of position of the movable main body section 601 immediately before receiving a booklet is shown in FIG. 19A. It is configured so that the movable main body section 601 shown in FIG. 19A receives the booklet 90 in a state where it is in an erected position with an inclined angle θ4. The inclined angle θ4 is an angle created between the bottom surface of the main body stand section 600 and the paper transfer surface (inclined section 75) of the movable main body section 601 and is at about 70° in this embodiment.

The booklet sensor 71 shown in FIG. 19A senses the booklet 90 naturally fallen from the bind-processing section 40 and outputs a booklet-sensing signal S71 to the signal-processing section 80. The signal-processing section 80 binarizes the booklet-sensing signal S71 into, for example, a three-bit positional detection data Dp and outputs it to the CPU 55. Upon receiving, from the signal-processing signal 80, the positional detection data Dp at the time when the booklet has been received, the CPU 55 outputs the motor control data Dm to the motor-driving section 70 which executes any booklet-drawing control.

The motor-driving section 70 drives the motor 69 to rotate forwardly (clockwise) by, for example, the predetermined number of steps, based on the motor drive signal S69 obtained by decoding the motor control data Dm. The motor 69 drives the belt drive shaft to rotate reversely based on the motor drive signal S69, so that the belts 68*a* and 68*b* start to descend. Then, the claws 67*a*, 67*b* attached to the belts 68*a* and 68*b* descend while holding the booklet 90. The motor 69 forwardly rotates by the predetermined number of steps, and then, stops.

Figure 19B:
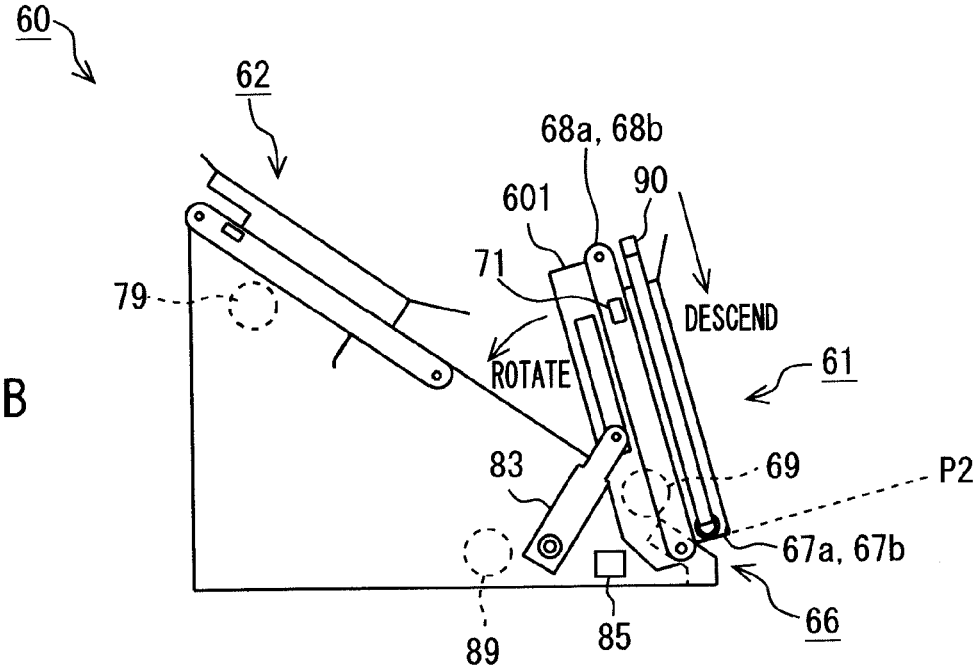

An exemplary state where the booklet 90 is drawn to the lowermost position of the belt unit 61 is shown in FIG. 19B. The position sensor 85 shown in FIG. 19B senses a regular position (hereinafter, referred to as a home position) of the movable main body section 601, and outputs the position-sensing signal S85 to the signal-processing section 80. The signal-processing section 80 binarizes the position-sensing signal S85 into, for example, three-bit positional detection data Dp, and outputs it to the CPU 55. Upon receiving the positional detection data Dp of the home position from the signal-processing signal 80, the CPU 55 outputs the motor control data Dm to the motor-driving section 70 which executes any movable main body rotation control.

The motor-driving section 70 drives the motor 89 to rotate reversely (counter-clockwise) by, for example, the predetermined number of steps, based on the motor drive signal S89 obtained by decoding the motor control data Dm. In the rotation mechanism section 66, the motor 89 reversely rotates a gear, not shown, based on the motor drive signal S89, so that the driving arm 83 is rotated counter-clockwise (from the inclined angle θ4 to θ3) and the movable main body section 601 starts to rotate counter-clockwise. The movable main body section 601 holding the booklet 90 diverse its traveling direction from the angle θ4 to θ3. In this moment, the motor 89 reversely rotates by the predetermined number of steps based on the motor drive signal S89 and then, stops.

An exemplary state where the booklet transfer surface of the movable main body section 601 and the booklet transfer surface of the belt unit 62 are in flush with each other is shown in FIG. 20A. The movable main body section 601 shown in FIG. 20A has the inclined angle θ3 when it is completely inclined. The inclined angle θ3 is an angle created between the bottom surface of the main body stand section 600 and the paper transfer surface (inclined portion 76) of the belt unit 62 and is at about 30° in this embodiment. The motor 89 is in a stopped state. In this state, the CPU 55 outputs motor control data Dm to the motor-driving section 70 which executes any booklet discharge control to the belt unit 61.

The motor-driving section 70 drives the motor 69 to rotate reversely (counter-clockwise) by, for example, a predetermined number of steps based on the motor drive signal S69 obtained by decoding the motor control data Dm. The motor 69 reversely rotates the belt drive shaft based on the motor drive signal S69, so that the belts 68*a* and 68*b* start to ascend. The claws 67*a* and 67*b* attached to the belts 68*a* and 68*b* ascend while holding the booklet 90. The motor 69 reversely rotates by a predetermined number of steps based on the motor drive signal S69 and then, stops.

An exemplary state at the time when the booklet 90 is relayed is shown in FIG. 20B. The booklet 90 shown in FIG. 20B reaches the belt unit 62 from the belt unit 61, and then, is relayed from the claws 67*a* and 67*b* to the claws 77*a* and 77*b* and then is pushed up. In this embodiment, the CPU 55 outputs the motor control data Dm based on the booklet discharge control program to the motor-driving section 70 which executes booklet transfer control after being relayed. It is configured so that, for example, the booklet 90 is completely halted at the belt unit 62 and the claws 77*a* and 77*b* are then driven to relay the operation of pushing up by the claws 67*a* and 67*b*. After this push-up operation is relayed, the motor-driving section 70 controls the belts 78*a*, 78*b* to move in such a manner that they push up the booklet 90 received from below to the uppermost position and make the booklet 90 fall to the stacker 63.

At this time, the motor-driving section 70 controls the motor 79 in such a manner as to cause the claws 77*a* and 77*b* of the belt unit 62 to hit against the booklet 90 in the self-activating area. Alternatively, the motor-driving section 70 may control the claws 77*a* and 77*b* of the belt unit 62 to accelerate at two or more steps for pushing up the booklet 90 along the booklet transfer surface.

An exemplary state at the time when discharging the booklet 90 is shown in FIG. 21. It is configured so that the booklet 90 shown in FIG. 21 pops out of the belt unit 62 onto the stacker 63, not shown, and is stacked therein. Further, the booklet sensor 72 senses the booklet 90 discharged to the stacker 63 and outputs the booklet-sensing signal S72 to the signal-processing section 80. The signal-processing section 80 binarizes the booklet-sensing signal S72 into positional detection data Dp and outputs it to the CPU 55. Upon receiving the positional detection data Dp at the time when discharging the booklet from the signal-processing section 80, the CPU 55 outputs the motor control data Dm to the motor-driving section 70 which executes any movable-main-body-section-returning control.

For example, the motor-driving section 70 drives the motor 89 so as to rotate forwardly (clockwise) by a predetermined number of steps based on the motor drive signal S89 obtained by decoding the motor control data Dm. In the rotation mechanism section 66, the motor 89 rotates a gear, not shown, based on the motor drive signal S89, so that the driving arm 83 moves clockwise (from the inclined angle θ3 to θ4) and the movable main body section 601 starts to rotate clockwise. The movable main body section 601 holding no booklet 90 changes its traveling direction from the angle θ3 to θ4. In this moment, the motor 89 forwardly rotates by a predetermined number of steps based on the motor drive signal S89, and then, stops.

By controlling, thus, the discharge unit 60, it becomes possible to provide a mechanism for transferring the booklet 90 while it is relayed from two belts 68*a*, 68*b* of the belt unit 61 to two belts 78*a* and 78*b* of the belt unit 62.

Figure 22:
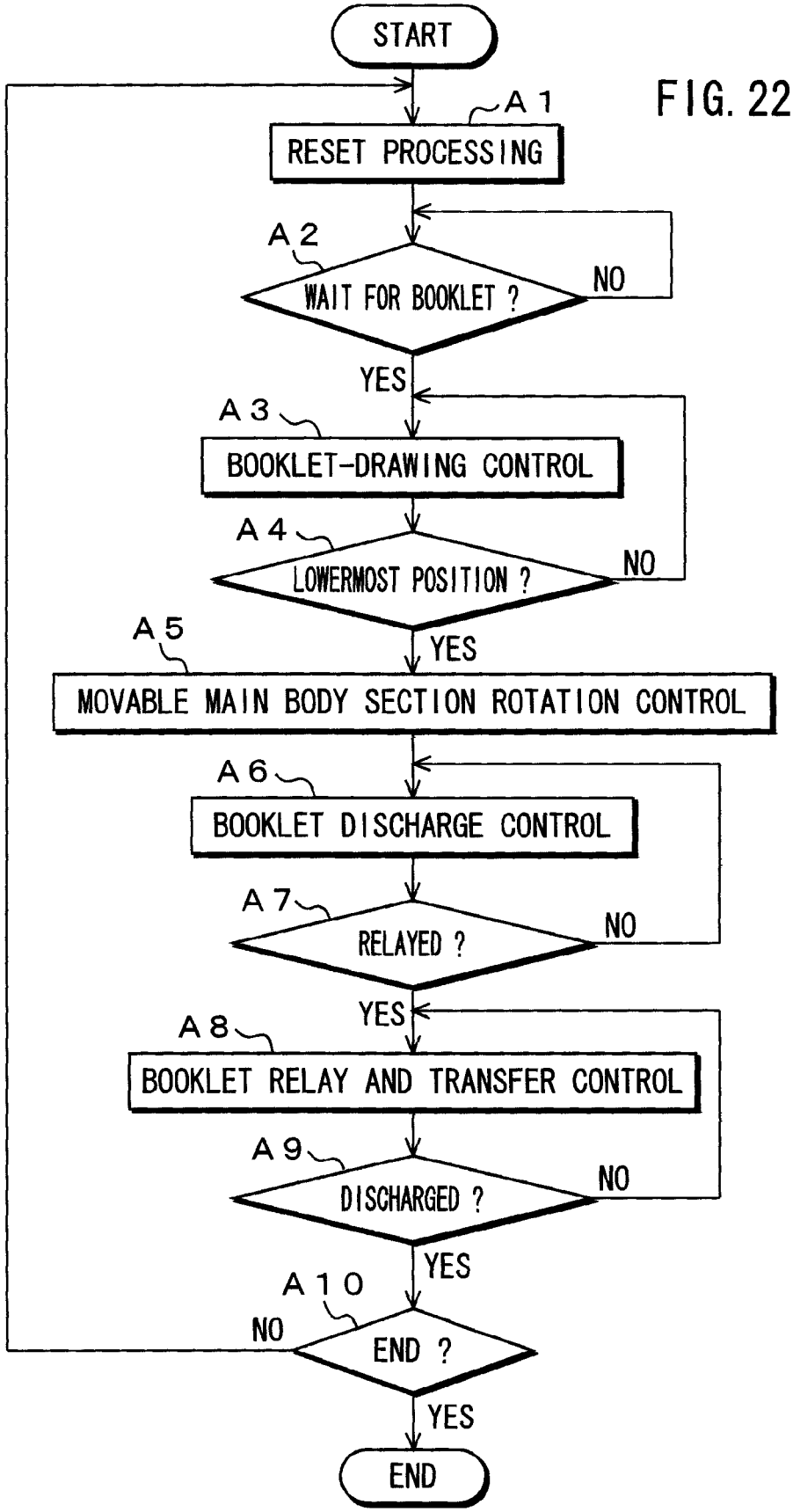
FIG. 22 is a flow chart for showing an exemplary control by a CPU 55 in the paper discharge unit 60.

Exemplary control of the CPU 55 executed to the discharge unit 60 is shown in FIG. 22. In this embodiment, illustrated is an exemplary case where the CPU 55 controls the motor-driving section 70 to drive the motor 79 in such a manner that the claws 77*a* and 77*b* of the belt unit 62 move within a self-activating area from the stand-by positions thereof to the positions to be brought into contact with the booklet 90 and the claws 77*a* and 77*b* of the belt unit 62 are accelerated until they reach the second position P2 after they are brought into contact with the booklet 90.

Under these control conditions, in Step A1 in the flowchart shown in FIG. 22, the CPU 55 executes reset processing. In the reset processing, the movable main body section 601 of the belt unit 61 is in a stand-up position with the inclined angle θ4, and the belts 68*a*, 68*b* are initially set in such a manner that the claws 67*a*, 67*b* are in a stand-by state at the first positions. Further, the belts 78*a*, 78*b* are initially set in such a manner that the claws 77*a*, 77*b* of the belt unit 62 are in a stand-by state on the back surface of the inclined portion 76. In this moment, the CPU 55 receives the position-detecting data Dp of the home position of the movable main body section 601 from the signal-processing section 80.

After that, in Step A2, the CPU 55 waits for the booklet 90 fallen. It is determined whether or not the booklet 90 has fallen based on the position-detecting data Dp from the signal-processing section 80. Upon receiving the position-detecting data Dp indicative of the receipt of the booklet from the signal-processing section 80, the process shifts into Step A3 where the CPU 55 outputs the motor control data Dm for controlling belts to the motor-driving section 70 which executes the booklet-drawing control shown in FIG. 19A. The motor-driving section 70 drives the motor 69 based on the motor control data Dm for controlling belts received from the CPU 55, for starting to descend the belts 68*a* and 68*b*.

Then, in Step A4, the CPU 55 detects whether or not the belts 68*a* and 68*b* holding the booklet 90 have reached to the lowermost position. It is determined whether or not they have been reached to the lowermost position based on whether or not the number of steps of the stepping motor based on the booklet discharge control program has reached to a specified number thereof. If the number of steps has not reached to the specified number, the process returns to Step A3 where it continues the booklet drawing control.

If the above-mentioned belts 68*a* and 68*b* reach the lowermost position, the process shifts to Step A5. In this moment, since the CPU 55 has already received the position-detecting data Dp of the home position of the movable main body section 601 from the signal-processing section 80, it outputs the motor control data Dm for controlling rotation to the motor-driving section 70 which executes the movable main body section rotation control shown in FIG. 19B.

Then, in Step A6, the CPU 55 outputs the motor control data Dm for discharging the booklet to the motor-driving section 70 which executes the booklet-discharging control shown in FIG. 20A. As a result, the belts start to move upward.

After that, in Step A7, the CPU 55 determines whether or not the booklet 90 has been relayed to the belt unit 62. It is determined whether or not the booklet 90 has been relayed to the belt unit 62 based on whether or not the number of steps of the stepping motor based on the booklet discharge control program has reached to a specified number thereof. If the number of steps has not reached to the specified number thereof, the process returns Step A6 where it continues the booklet delivery control.

Upon confirming that the booklet 90 has been relayed, the process shits to Step A8 where the CPU 55 outputs the motor control data Dm for transferring the booklet after being relayed based on the booklet discharge control program to the motor-driving section 70 which executes the booklet-transferring control after being relayed shown in FIG. 20B.

After that, in Step A9, the CPU 55 detects whether or not the booklet 90 has been discharged to the stacker 63. In this moment, upon receiving the position-detecting data Dp at the time when discharging the booklet from the signal-processing section 80, the CPU 55 outputs the motor control data Dm for returning the movable main body to the motor-driving section 70 which executes the movable-main-body-section-returning control. The motor-driving section 70 drives the motor 89 to rotate forwardly (clockwise) by the predetermined number of steps based on the motor drive signal S89 obtained by decoding the motor control data Dm. The motor 89 rotates a gear, not shown, forward, so that the driving arm 83 moves clockwise (from the inclined angle θ3 to θ4) and the movable main body section 601 starts to rotate clockwise. The movable main body section 601 changes its traveling direction from the angle θ3 to θ4 to return its home position.

After that, in Step A10, the CPU 55 determines whether or not the discharge processing is ended. In this moment, the CPU 55 communicates with the bind-processing section 40 which is higher rank, to recognize the presence or absence of the booklet 90 which is to be discharged. It is configured so that when there is the booklet 90 to be discharged from the higher-rank bind-processing section 40, the process returns Step A1 where it repeats the above-described processing. For example, it is configured so that after each constituent section is reset, the process shifts to Step A2 where it waits for the booklet 90 fallen therefrom.

It is configured so that in Step 10, when there is no booklet 90 to be discharged from the higher-rank bind-processing section 40 or information indicative of power supply off has been detected, this discharge processing terminates. As a result that the motors 69, 79, and 89 are thus controlled by the CPU 55 through the motor-driving section 70, malfunction of the motors can be prevented, and these motors can be linearly controlled one by one.

Thus, according to the binding apparatus 100 of the fourth embodiment, the punch-processing section 20 is disposed in such a manner that its paper-punching surface is set at a position having a first depression angle θ1 relative to the transfer surface of the paper-transferring section 10, and the binder-paper-aligning unit 30 is disposed in such a manner that its paper-retaining surface is set at a position having a second depression angle θ2 relative to the transfer surface of the paper-transferring section 10, without disposing the punch-processing section 20 on the transfer route of the paper-transferring section 10, wherein the relationship between the first depression angle and the second depression angle is set to satisfy $\theta 1<\theta 2$.

Therefore, in transferring the sheet of paper from the punch-processing section 20 to the binder-paper-aligning unit 30, it becomes possible to utilize the own-weight drop of the sheet of paper 3 in the gravity direction. In addition, the discharge unit 60 can be configured so that the booklet 90 is also fallen utilizing its own weight in the gravity direction from the binder-paper-aligning unit 30 to the discharge unit 60. This enables the sheet of paper 3 and the booklet 90 to be moved linearly, and thus, the moving distances of the sheet of paper 3 and the booklet 90 can be set to shorter than those of the paper transfer path accompanying the U-turn.

On top of the effects described above, the following effects also can be obtained.

i. A period of running time for each of the motors can be shortened, and thus, the durability of each of the motors can be enhanced and power consumption by each of the motors can be reduced.

ii. The width of the main body device can be reduced as compared with the case where the relationship between the first depression angle and the second depression angle is set to $\theta 1 \geqq \theta 2$, so that the binding apparatus 100 can be compact in size. In the case where a paper transfer path accompanying with a U-turn is installed, a space for the curvature thereof is needed, resulting in increasing the size of the apparatus, but in the prevent invention, since the transfer path in the shape of the reversed letter Z can be employed, it becomes possible to downsize the apparatus.

iii. Since a U-turn transfer configuration as of a conventional scheme is not employed, the occurrence of paper jamming in the environment where the paper rigidity increases due to low temperature and low humidity can be reduced. Further, since there is no paper transfer path accompanying with a U-turn, an ability to release paper jamming is excellent (it is easy to access the jammed paper by hand) and manufacturing cost is suppressed to low.

iv. Since the punch-processing section 20 is installed in the route dedicated to binding operation (only a dedicated path), instead of being installed on a through-pass route, it is possible to prevent the sheet of paper from getting caught in the punched holes.

Embodiment 5

Figure 23:
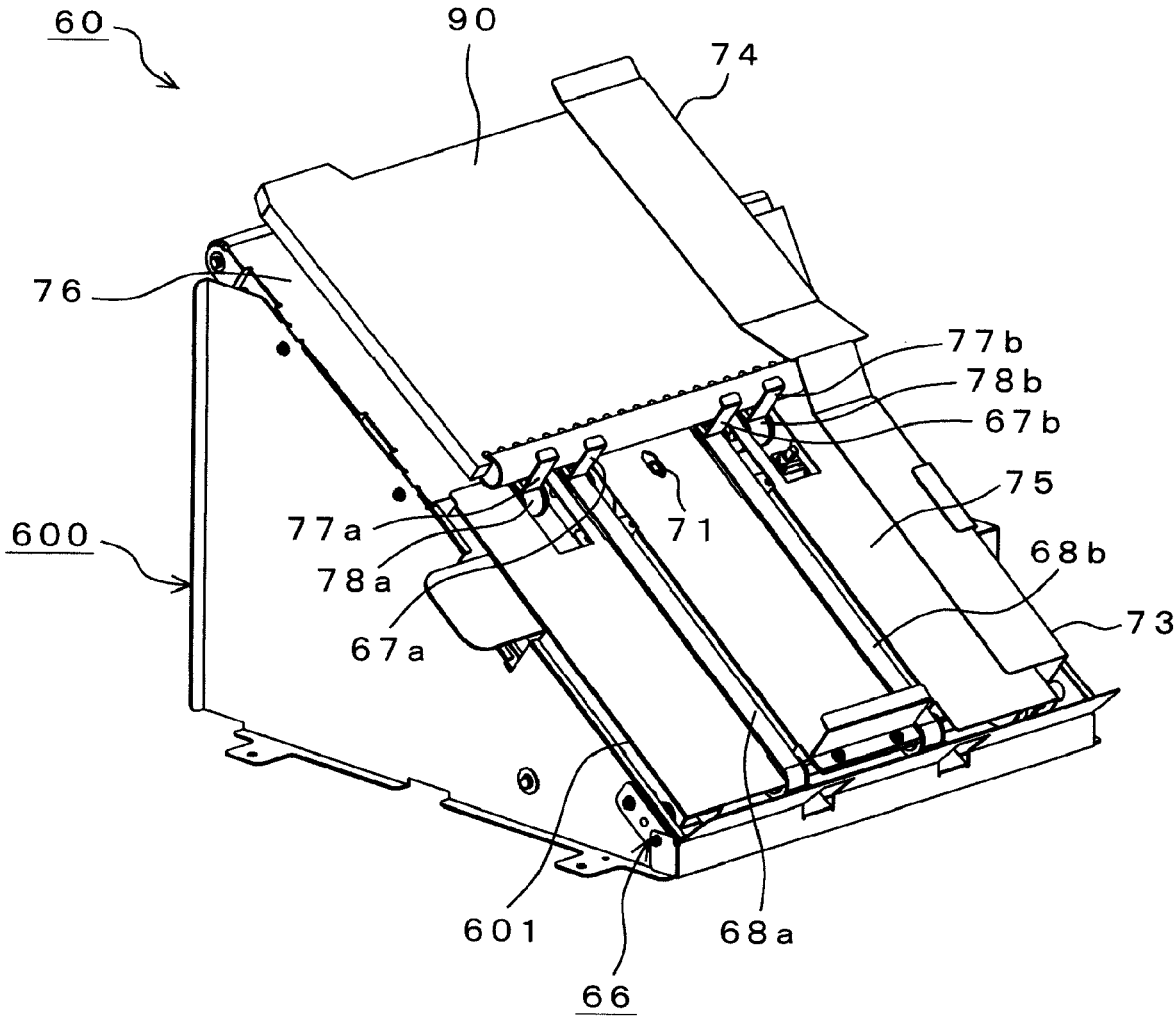
FIG. 23 is a perspective view for showing an exemplary booklet relay transfer between belt units as a fifth embodiment.

An example of booklet relay and transfer operation between the belt units according to a fifth embodiment is shown in FIG. 23. Although, in the fourth embodiment described above, the case where the booklet 90 is relayed at the point of time when the claws 67*a* and 67*b* completely halt at the belt unit 62 has been described, the booklet 90 is relayed while it is running in the fifth embodiment. It is to be noted that the items having the names and reference numerals same as those of the fourth embodiment have the same functions, and thus, their descriptions will be omitted.

According to the discharge unit 60 shown in FIG. 23, the motor-driving section 70 shown in FIG. 18 controls two motors 69 and 79 to move the claws 67*a* and 67*b* of the belt unit 61 and the claws 77*a* and 77*b* of the belt unit 62 at the same speed at the time when relaying the booklet. By transferring it at the same speed as described above, there is no booklet-halting time, and the processing as a whole can be speeded up.

In this embodiment, it is configured so that the motor-driving section 70 continuously pushes up and transfers the booklet 90 without applying impact load thereto, in a state where the belt-moving speed immediately before the claws 67*a* and 67*b* of the belt unit 61 reaches the end portion of the belt unit 62 and the speed when the claws 77*a* and 77*b* of the belt unit 62 are moved from their home positions to the booklet-receiving position are kept same with each other. Such the control can be achieved by processing the belt unit 61 and the belt unit 62 in parallel. Further, impact of the belt unit 62 to the booklet 90 can be reduced, and the motor 79 can be used within a high torque range in a self-activating area, resulting in preventing the motor from malfunction.

Thus, according to the discharge unit 60 as a fifth embodiment, the belt unit 61 and the belt unit 62 are processed in parallel so that even if it is impossible to control the motors to accelerate and decelerate one by one because only one timer for the CPU 55 can be allocated to the motor-driving section 70, a booklet 90 consisting a large number of sheets of paper and thus heavy in weight can be transferred, thereby enabling the CPU 55, the motors 69, 79, and 89 and the like which are low in cost to be used.

Embodiment 6

Figure 24:
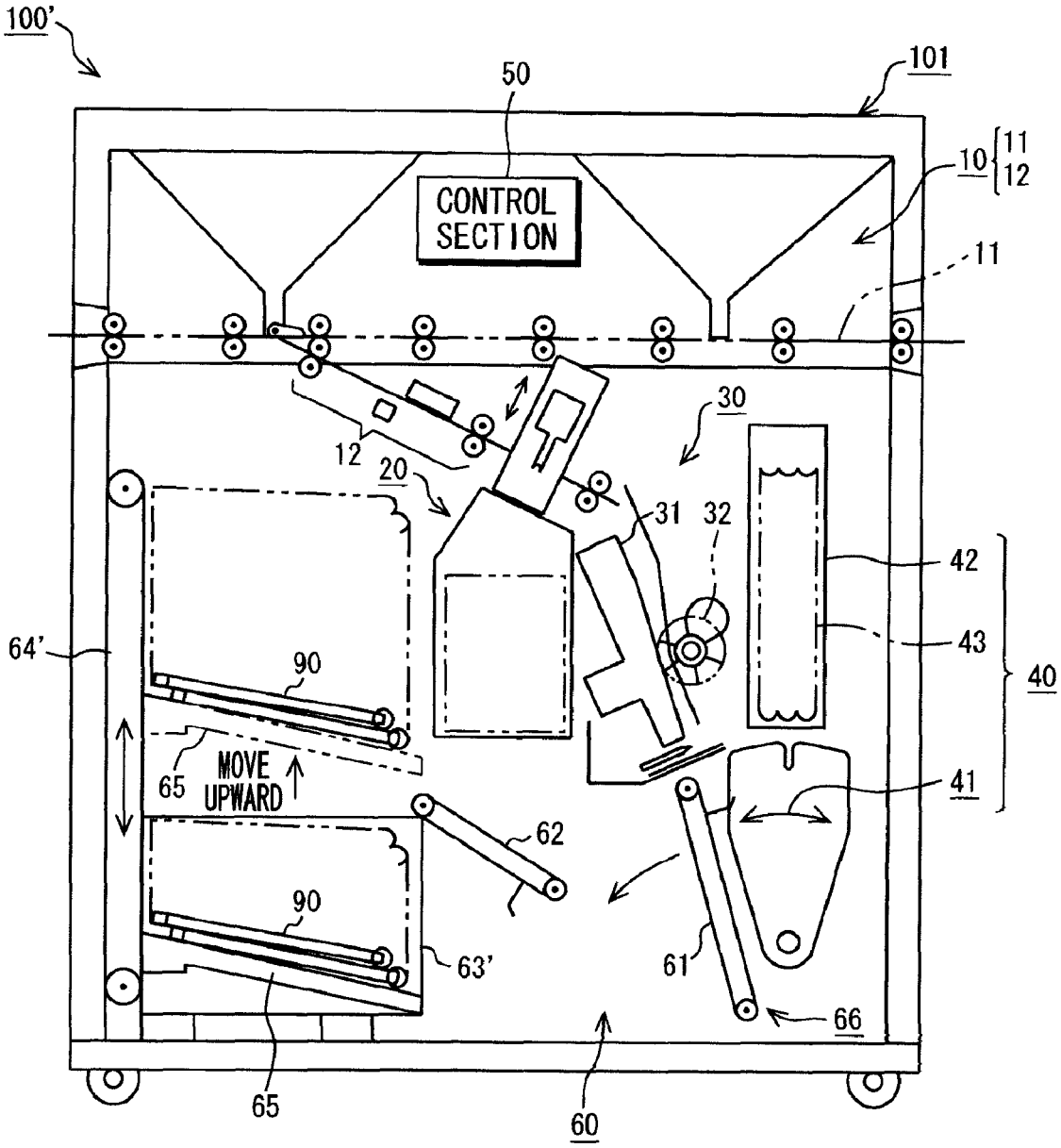
FIG. 24 is a schematic diagram for showing a configuration of a binding apparatus 100' as a sixth embodiment.
Figure 25:
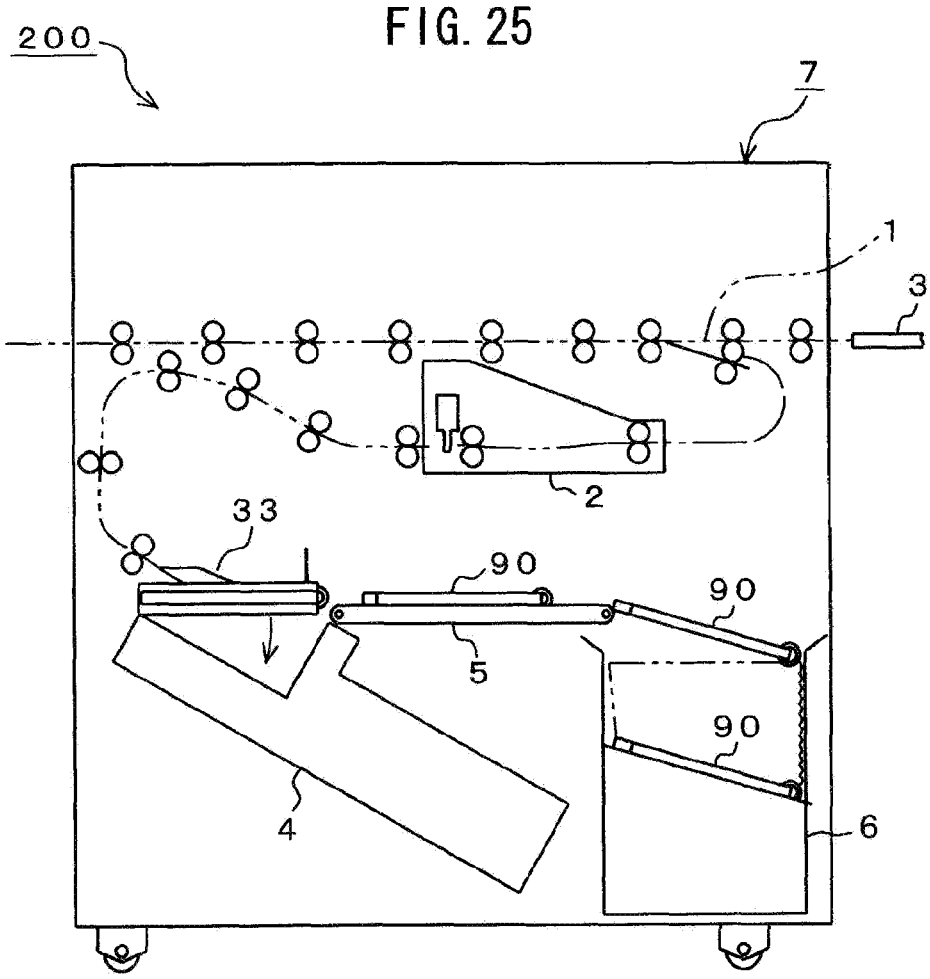
FIG. 25 is a schematic diagram for showing an exemplary arrangement of a punch-processing section 2 and a binder-paper-aligning unit 33 according to a conventional example.

A configuration of a stacker 63' as a sixth embodiment is shown in FIG. 24. The stacker 63' shown in FIG. 24 is designed so that a belt-driving section 64' of the stacker 63' has a height higher than the example illustrated in FIG. 16, in order to enable the booklet 90 to be moved upward to a higher position. The height of the belt-driving section 64' is configured as to move the lifting portion 65 upward to a position about twice as high as the booklet discharge position of the belt unit 62 and then move it downward therefrom. The belt-driving section 64' is disposed at a left side of the apparatus main body section (housing) 101. The stacker 63' is constituted of two stackers. It is to be noted that the items having the names and reference numerals same as those of the fourth and fifth embodiment have the same functions, and therefore, their descriptions will be omitted.

According to the binding apparatus 100' as a sixth embodiment, the booklets 90 in the group initially discharged is put into an upper stacker and conveyed upward, whereas the booklets 90 in the next group is accommodated into a lower stacker, so that an increased capacity for accommodating the booklets can be achieved by two stackers. Thus, each group of the booklets 90 can be discharged separately. Further, since the discharge port for the booklets 90 accommodated within the stacker 63' can be set at high position, its operability is improved as compared with a case where the discharge port is located at low position. Thereby, a space within the apparatus main body section 101 can be efficiently utilized.

INDUSTRIAL APPLICABILITY

The present invention is very preferably applied to a binding apparatus for automatically binding recorded sheets of paper discharged from a monochrome and color copying machine or a printer.

The invention claimed is:

1. A paper processing and punching apparatus for punching holes in a sheet of predetermined paper to discharge the sheet of paper, comprising:

a paper-transferring section containing a first transfer path for transferring of paper one by one toward a predetermined position and a second transfer path to which a transfer route is switchable from the first transfer path;

a punch processing section that receives the sheets of paper transferred by the paper-transferring section one by one and punches two or more holes for binding at one end of each received sheet;

a paper-position-correcting means for correcting a position of the sheet of paper to be punched;

a paper aligning unit that aligns the plurality of sheets of paper punched by the punch processing section and temporarily retains them;

a bind processing section for binding the plurality of sheets of paper aligned by the paper aligning unit with a binding member to create the booklet, the bind processing section containing a moving mechanism that holds the binding member to fit the binding member through the punched holes; and controlling means for controlling the paper-transferring paper-transferring section, the punch processing section and the paper-position-correcting means, wherein the controlling means controls the paper-transferring section so as to decelerate and stop the transfer of the sheet of paper at the predetermined position on the first transfer path, to switch the paper transfer route, then, from the first transfer path to the second transfer path, and to deliver the sheet of paper in a reverse direction thereof, and the controlling means controls the paper-position-correcting means so as to correct the position of the sheet of paper before punching the sheet of paper, and wherein the moving mechanism rotates back and forth between a first position along the paper transfer direction of the paper aligning unit and a second position on a line intersecting with the transfer direction of the paper-transferring section to fit the binding member through the punched holes.

2. The paper processing and punching apparatus according to claim 1, wherein a paper-transferring direction by the first transfer path and a paper-transferring direction by the second transfer path contains a predetermined angle therebetween.

3. The paper processing and punching apparatus according to claim 1, comprising an upstream image-forming device and another downstream paper processing and punching apparatus and wherein the first transfer path is located between the upstream image-forming device and the downstream paper processing and punching apparatus, and the first transfer path has a through-pass function of relaying the sheet of paper from the image-forming device to the downstream paper processing and punching apparatus.

4. The paper processing and punching apparatus according to claim 1, wherein the controlling means sets the transfer speed of the sheet of paper on the first transfer path to be higher than the transfer speed thereof at the time when the sheet of paper is fed, to elongate an interval between the sheets of paper.

5. The paper processing and punching apparatus according to claim 1, wherein the apparatus is further provided with positional reference means as positional reference for the end portion of the sheet of paper, and wherein the controlling means controls the paper-transferring section so as to decelerate the sheet of paper before the sheet of paper strikes against the positional reference means.

6. The paper processing and punching apparatus according to claim 1, wherein the controlling means controls the paper-transferring section so as to exert acceleration force to the sheet of paper during a punching operation performed by the punch-processing section.

7. The paper processing and punching apparatus according to claim 5, wherein the controlling means controls the paper-transferring section so as to hit the sheet of paper against the positional reference means with low load during a punching operation performed by the punch-processing section.

8. The paper processing and punching apparatus according to claim 5, wherein the controlling means controls the punch-processing section so as to punch a top end of the sheet of paper after the sheet of paper strikes the positional reference means.

9. The paper processing and punching apparatus according to claim 5, wherein the controlling means controls the paper-transferring section so as to exert acceleration force again to the sheet of paper during a punching operation performed by the punch-processing section and to hit the sheet of paper against the positional reference means.

10. A paper processing and punching apparatus for binding a plurality of sheets of paper with a binding member to create a booklet, comprising:

a paper-transferring section that transfers the sheets of paper one by one to a predetermined position, the paper-transferring section having a substantially horizontal transfer surface;

a punch-processing section that receives the sheets of paper transferred by the paper-transferring section one by one on a paper punching surface and punches two or more holes for binding at one end of each received sheet;

a paper-position-correcting means for correcting a position of the sheet of paper to be punched;

a paper-aligning unit that aligns the plurality of sheets of paper punched by the punch-processing section and temporality retains them on a paper-retaining surface; and a bind processing section that binds the plurality of sheets of paper aligned by the paper-aligning unit with binding member to create the booklet, wherein the punch-processing section is disposed in such a manner that its paper-punching surface is set at a position having a first depression angle θ1 relative to the transfer surface of the paper-transferring section, wherein the paper-aligning unit is disposed in such a manner that its paper-retaining surface is set at a position having a second depression angle θ2 relative to the transfer surface of the paper-transferring section, wherein the relationship between the first depression angle and the second depression angle is set to $0<\theta 1<\theta 2$, and wherein the bind processing section contains a moving mechanism that rotates back and forth between a first position along the paper transfer direction of the paper-aligning unit and a second position on a line intersecting with the transfer direction of the paper-transferring section to fit the binding member through the punched holes.

11. The paper processing and punching apparatus according to claim 10, wherein the apparatus is also provided with discharging means for discharging the booklet created by the bind processing section, wherein the discharging means contains:

a booklet-receiving-and-switching section for receiving the booklet fallen from the the bind processing section and switching its delivery direction;

a booklet-transferring section for transferring the booklet whose delivery direction has been switched by the booklet-receiving-and-switching section; and a booklet-accumulating section for accumulating the booklet transferred by the booklet-transferring section.

12. The paper processing and punching apparatus according to claim 11, wherein the booklet-receiving-and-switching section contains:

a main body portion having a booklet transfer surface;

a rotation mechanism portion for rotating the main body portion only by a predetermined angle;

a claw portion for receiving the booklet at the booklet transfer surface of the main body portion; and a driving portion for driving the claw portion.

13. The paper processing and punching apparatus according to claim 12, wherein the driving portion of the booklet-receiving-and-switching section is operative to control and move the claw portion successively to a first position for receiving the booklet from above, a second position for moving the booklet downward to a lowermost position, and a third position for pushing up the booklet to relay it to the booklet-transferring section.

14. The paper processing and punching apparatus according to claim 12, wherein the rotating mechanism portion is operative when the claw portion is at the second position to rotate the main body portion toward a side of the booklet-transferring section.

15. The paper processing and punching apparatus according to claim 12, wherein the rotating mechanism portion is operative when the claw portion is at the second position to rotate the main body portion to a position where the booklet transfer surface of the booklet-receiving-and-switching section and the booklet transfer surface of the booklet-transferring section are in flush with each other.

16. The paper processing and punching apparatus according to claim 11, wherein the booklet-transferring section contains:

a main body portion having a booklet transfer surface;

a claw portion for receiving the booklet at the booklet transfer surface of the main body portion from the booklet-receiving-and-switching section; and a driving portion for driving the claw portion.

17. The paper processing and punching apparatus according to claim 16, wherein the driving portion of the booklet-transferring section is operative to control and move the claw portion successively to a first position for engaging the booklet from below and a second position for pushing up the booklet to an uppermost position and allowing the booklet to fall to the booklet-accumulating section therefrom.

18. The paper processing and punching apparatus according to claim 16, wherein the driving portion of the booklet-transferring section is operative to control and move the claw portion in such a manner that, after the booklet has been received from the booklet-receiving-and-switching section, the claw portion of the booklet-transferring section engages a rear end of the booklet and pushes the booklet upward.

19. The paper processing and punching apparatus according to claim 16, wherein the driving portion of the booklet-transferring section is operative to move the claw portion of the booklet-transferring section through a predetermined distance from a stand-by state to a position where the claw portion engages the booklet.

20. The paper processing and punching apparatus according to claim 16, further comprising a controlling means and wherein the driving portion of the booklet-transferring section comprises a motor coupled to the claw portion and the controlling means controls driving of the motor to move the claw portion within a self-activating area from a position where the claw portion of the booklet-transferring section is in a stand-by state to a position where the claw portion engages the booklet, and to accelerate the claw portion from a point of time when the claw portion of the booklet-transferring section engages the booklet until the claw portion of the booklet-transferring section reaches the second position.

21. The paper processing and punching apparatus according to claim 20, wherein the controlling means controls the motor to cause the claw portion of the booklet-transferring section to engage the booklet within the self-activating area.

22. The paper processing and punching apparatus according to claim 20, wherein the controlling means controls the motor to accelerate the claw portion of the booklet-transferring section at two or more steps.

23. The paper processing and punching apparatus according to claim 16, wherein the booklet-receiving-and-switching section contains:

a main body portion having a booklet transfer surface;

a claw portion for receiving the booklet at the booklet transfer surface of the main body portion; and a driving portion for driving the claw portion, and the driving portion of the booklet-transferring section and the driving portion of the booklet-receiving-and-switching section are operative to control the claw portion of the booklet-receiving-and-switching section and the claw portion of the booklet-transferring section so as to move at the same speed with each other at the time of relaying the booklet.

24. The paper processing and punching apparatus according to claim 16, wherein the booklet-receiving-and-switching section contains:

a main body portion having a booklet transfer surface;

a claw portion for receiving the booklet at the booklet transfer surface of the main body portion; and a driving portion for driving the claw portion, and the driving portion of the booklet-transferring section and the driving portion of the booklet-receiving-and-switching section are operative to control the claw portion of the booklet-transferring section and the claw portion of the booklet-receiving-and-switching section such that the speed of movement of the claw portion of the booklet-transferring section from a standby position to a booklet-receiving position is the same as the speed of movement of the claw portion of the booklet-receiving-and-switching section immediately before the claw portion of the booklet-receiving-and-switching section reaches to an end portion of booklet-transferring section whereby the driving portion of the booklet-transferring section transfers the booklet without exerting impact load.

25. The paper processing and punching apparatus according to claim 12, wherein the booklet-receiving-and-switching section contains a belt in driven relationship with the driving portion and to which the claw portion is attached.

26. The paper processing and punching apparatus according to claim 10, wherein the bind processing section further comprises a binder cassette for containing binding members, and wherein the moving mechanism draws a binding member from the binder cassette at the second position, rotates from the second position to the first position and fits the binding member through the punched holes.

27. The paper processing and punching apparatus according to claim 1, wherein the bind processing section further comprises a binder cassette for containing binding members, and wherein the moving mechanism draws a binding member from the binder cassette at the second position rotates to the first position, and fits the binding member through the punched holes.

28. The paper processing and punching apparatus according to claim 1, comprising first transfer rollers for transferring the sheet of paper along an upstream segment of the first transfer path, a first transfer-roller driving section for driving the first transfer rollers for transferring the sheet of paper along an upstream segment of the first transfer path, and a second transfer-roller driving section for driving the second transfer rollers for transferring the sheet of paper along a downstream segment of the first transfer path, and wherein the first transfer-roller driving section is responsive to the controlling means for driving the first transfer rollers to transfer the sheet of paper along the upstream segment of the first transfer path at a first speed and the second transfer-roller driving section is responsive to the controlling means for driving the second transfer rollers to transfer the paper sheet along the downstream segment of the first transfer path at a second speed, higher than the first speed.

29. The paper processing and punching apparatus according to claim 1, wherein the apparatus comprises transfer rollers for transferring the sheet of paper along the second transfer path and a transfer-roller driving section for driving the transfer rollers for transferring the sheet of paper along the second transfer path, the paper-position-correcting means comprises a fence to be engaged by the sheet of paper transferred along the second transfer path, and the transfer-roller driving section is responsive to the controlling means for driving the transfer rollers so as to exert an acceleration force on the sheet of paper engaging the fence during a punching operation performed by the punch-processing section.

30. The paper processing and punching apparatus according to claim 5, wherein the positional reference means comprises a fence and the apparatus comprises transfer rollers for transferring the sheet of paper along the second transfer path and a transfer-roller driving section for driving the transfer rollers for transferring the sheet of paper along the second transfer path to engage the fence, and the transfer-roller driving section is responsive to the controlling means for driving the transfer rollers so as to engage the sheet of paper against the fence with a low load during a punching operation performed by the punch-processing section.

31. The paper processing and punching apparatus according to claim 5, wherein the punch-processing section is positioned relative to the positional reference means so as to punch a top end of the sheet of paper engaging the positional reference means.

32. The paper processing and punching apparatus according to claim 5, wherein the positional reference means comprises a fence and the apparatus comprises transfer rollers for transferring the sheet of paper along the second transfer path and a transfer-roller driving section for driving the transfer rollers for transferring the sheet of paper along the second transfer path to engage the fence, and the transfer-roller driving section is responsive to the controlling means after deceleration of the sheet of paper for driving the transfer rollers so as to exert an acceleration force on the sheet of paper to hit the sheet of paper against the fence during a punching operation performed by the punch-processing section.

* * * * *